US007157214B2

(12) United States Patent
Zou et al.

(10) Patent No.: US 7,157,214 B2
(45) **Date of Patent: *Jan. 2, 2007**

(54) HIGH-SPEED THERMALLY DEVELOPABLE IMAGING MATERIALS

(75) Inventors: Chaofeng Zou, Maplewood, MN (US); Doreen C. Lynch, Afton, MN (US)

(73) Assignee: Eastman Kodak Company, Rochester, NY (US)

( * ) Notice: Subject to any disclaimer, the term of this patent is extended or adjusted under 35 U.S.C. 154(b) by 80 days.

This patent is subject to a terminal disclaimer.

(21) Appl. No.: 10/979,467

(22) Filed: Nov. 2, 2004

(65) Prior Publication Data

US 2005/0069828 A1 Mar. 31, 2005

Related U.S. Application Data

(63) Continuation-in-part of application No. 10/414,772, filed on Apr. 16, 2003, now Pat. No. 6,844,145, which is a continuation-in-part of application No. 10/194,588, filed on Jul. 11, 2002, now Pat. No. 6,576,410, said application No. 10/979,467 is a continuation-in-part of application No. 10/641,206, filed on Aug. 14, 2003, now Pat. No. 6,964,842, which is a continuation-in-part of application No. 10/193,443, filed on Jul. 11, 2002, now Pat. No. 6,713,240.

(51) Int. Cl.

| | |
|---|---|
| ***G03C 5/16*** | (2006.01) |
| ***G03C 1/00*** | (2006.01) |
| ***G03C 1/005*** | (2006.01) |
| ***G03C 1/494*** | (2006.01) |

(52) U.S. Cl. ..... 430/350; 430/348; 430/617; 430/618; 430/619; 430/620; 430/510; 430/567; 430/570; 430/523; 430/546

(58) Field of Classification Search ..... 430/348, 430/350, 617–620, 510, 567, 523, 546, 570
See application file for complete search history.

(56) References Cited

U.S. PATENT DOCUMENTS

| | | | |
|---|---|---|---|
| 4,435,499 | A | 3/1984 | Reeves |
| 4,504,575 | A | 3/1985 | Lee |
| 5,494,789 | A | 2/1996 | Daubendiek et al. |
| 5,503,970 | A | 4/1996 | Olm et al. |
| 5,503,971 | A | 4/1996 | Daubendiek et al. |
| 5,691,127 | A | 11/1997 | Daubendiek et al. |
| 5,840,475 | A | 11/1998 | Levy et al. |
| 5,876,905 | A | 3/1999 | Irving et al. |
| 5,962,206 | A | 10/1999 | Hall |
| 5,965,346 | A | 10/1999 | Inagaki et al. |
| 6,083,680 | A | 7/2000 | Ito et al. |
| 6,277,549 | B1 | 8/2001 | DeKeyzer et al. |
| 6,277,550 | B1 | 8/2001 | Elst et al. |
| 6,413,710 | B1 | 7/2002 | Shor |
| 6,423,481 | B1 | 7/2002 | Simpson et al. |
| 6,423,487 | B1 | 7/2002 | Naoi |
| 6,440,649 | B1 | 8/2002 | Simpson et al. |
| 6,576,410 | B1 | 6/2003 | Zou et al. |
| 6,713,240 | B1 | 3/2004 | Lynch et al. |
| 2004/0131983 | A1 | 7/2004 | Ohzeki et al. |

FOREIGN PATENT DOCUMENTS

| | | | |
|---|---|---|---|
| EP | 0 844 514 | A1 | 5/1998 |

OTHER PUBLICATIONS

U.S. Appl. No. 10/193,341, filed Jul. 11, 2002, titled *Method For Making Tabular Grain Silver Halide Emulsion*, by Daubendiek et al.
U.S. Appl. No. 10/193,443, filed Jul. 11, 2002, titled *Black-and-White Aqueous Photothermographic Materials Containing Mercaptotriazole Toners*, by Lynch et al.
NTIS Report AFAL-TR-72-11, :Dry Silver Camera Film, Aerial Exposure Index = 5, Mar. 1975.
*Research Disclosure*, Item 17707, Jan. 1979.

*Primary Examiner*—Geraldine Letscher
(74) *Attorney, Agent, or Firm*—J. Lanny Tucker; Louis M. Leichter

(57) ABSTRACT

High-speed aqueous-based black-and-white photothermographic materials are imageable in any suitable fashion using ultraviolet, visible, infrared, or X-radiation. They can have one or more thermally developable imaging layers on either or both sides of the support and can be imaged with or without a phosphor intensifying screen in an imaging assembly. The photothermographic emulsions and materials have a net $D_{min}$ less than 0.25, and require less than 1 erg/cm$^2$ to achieve a density of 1.00 above net $D_{min}$. The imaging layers include hydrophilic binders or water-dispersible latex polymer binders and chemically and spectrally sensitized photosensitive silver halide grains.

29 Claims, No Drawings

HIGH-SPEED THERMALLY DEVELOPABLE IMAGING MATERIALS

RELATED APPLICATIONS

This application is a Continuation-in-part of commonly assigned and U.S. Ser. No. 10/414,772 filed by Zou et al. on Apr. 16, 2003, now U.S. Pat. No. 6,844,145 that, in turn, is a Continuation-in-part of U.S. Ser. No. 10/194,588 filed by Zou et al. on Jul. 11, 2002 that has issued into U.S. Pat. No. 6,576,410 (Zou et al.). This application is also a Continuation-in-part of commonly assigned and U.S. Ser. No. 10/641,206 filed by Zou et al. on Aug. 14, 2003, now U.S. Pat. No. 6,964,842 that, in turn, is a Continuation-in-part of U.S. Ser. No. 10/193,443 filed Jul. 11, 2002 by Lynch et al. that has issued into U.S. Pat. No. 6,713,240 (Lynch et al.).

FIELD OF THE INVENTION

This invention is directed to photothermography and relates to high-speed aqueous-based black-and-white photothermographic materials requiring less than 1 erg/cm$^2$ to achieve a density of 1.00 above net $D_{min}$. The invention also relates to methods of imaging using these materials.

BACKGROUND OF THE INVENTION

Silver-containing photothermographic imaging materials that are developed with heat and without liquid development have been known in the art for many years. Such materials are used in a recording process wherein an image is formed by imagewise exposure of the photothermographic material to specific electromagnetic radiation (for example, visible, ultraviolet, or infrared radiation) and developed by the use of thermal energy. These materials, also known as "dry silver" materials, generally comprise a support having coated thereon: (a) a photocatalyst (that is, a photosensitive compound such as silver halide) that upon such exposure provides a latent image in exposed grains that are capable of acting as a catalyst for the subsequent formation of a silver image in a development step, (b) a non-photosensitive source of reducible silver ions, (c) a reducing agent composition (usually including a developer) for the reducible silver ions, and (d) a hydrophilic or hydrophobic binder. The latent image is then developed by application of thermal energy.

In such materials, the photosensitive catalyst is generally a photographic type photosensitive silver halide that is considered to be in catalytic proximity to the non-photosensitive source of reducible silver ions. Catalytic proximity requires intimate physical association of these two components either prior to or during the thermal image development process so that when silver atoms $(Ag^0)_n$, also known as silver specks, clusters, nuclei or latent image, are generated by irradiation or light exposure of the photosensitive silver halide, those silver atoms are able to catalyze the reduction of the reducible silver ions within a catalytic sphere of influence around the silver atoms [D. H. Klosterboer, *Imaging Processes and Materials*, (*Neblette's Eighth Edition*), J. Sturge, V. Walworth, and A. Shepp, Eds., Van Nostrand-Reinhold, New York, 1989, Chapter 9, pp. 279–291]. It has long been understood that silver atoms act as a catalyst for the reduction of silver ions, and that the photosensitive silver halide can be placed in catalytic proximity with the non-photosensitive source of reducible silver ions in a number of different ways (see, for example, *Research Disclosure*, June 1978, Item 17029). Other photosensitive materials, such as titanium dioxide, cadmium sulfide, and zinc oxide have also been reported to be useful in place of silver halide as the photocatalyst in photothermographic materials [see for example, Shepard, *J. Appl. Photog. Eng.* 1982, 8(5), 210–212, Shigeo et al., *Nippon Kagaku Kaishi,* 1994, 11, 992–997, and FR 2,254,047 (Robillard)].

The photosensitive silver halide may be made "in-situ," for example by mixing an organic or inorganic halide-containing source with a source of reducible silver ions to achieve partial metathesis and thus causing the in-situ formation of silver halide (AgX) grains throughout the silver source [see, for example, U.S. Pat. No. 3,457,075 (Morgan et al.)]. In addition, photosensitive silver halides and sources of reducible silver ions can be coprecipitated [see Yu. E. Usanov et al., *J. Imag. Sci. Tech.* 1996, 40, 104]. Alternatively, a portion of the reducible silver ions can be completely converted to silver halide, and that portion can be added back to the source of reducible silver ions (see Yu. E. Usanov et al., International Conference on Imaging Science, Sep. 7–11, 1998, pp. 67–70).

The silver halide may also be "preformed" and prepared by an "ex-situ" process whereby the silver halide (AgX) grains are prepared and grown separately. With this technique, one has the possibility of controlling the grain size, grain size distribution, dopant levels, and composition much more precisely, so that one can impart more specific properties to both the silver halide grains and the photothermographic material. The preformed silver halide grains may be introduced prior to and be present during the formation of the source of reducible silver ions. Co-precipitation of the silver halide and the source of reducible silver ions provides a more intimate mixture of the two materials [see for example U.S. Pat. No. 3,839,049 (Simons)]. Alternatively, the preformed silver halide grains may be added to and physically mixed with the source of reducible silver ions.

The non-photosensitive source of reducible silver ions is a material that contains reducible silver ions. Typically, the preferred non-photosensitive source of reducible silver ions is a silver salt of a long chain aliphatic carboxylic acid having from 10 to 30 carbon atoms, or mixtures of such salts. Such acids are also known as "fatty acids" or "fatty carboxylic acids." Silver salts of other organic acids or other organic compounds, such as silver imidazoles, silver tetrazoles, silver benzotriazoles, silver benzotetrazoles, silver benzothiazoles and silver acetylides may also be used. U.S. Pat. No. 4,260,677 (Winslow et al.) discloses the use of complexes of various inorganic or organic silver salts.

In photothermographic materials, exposure of the photographic silver halide to light produces small clusters containing silver atoms $(Ag^0)_n$. The imagewise distribution of these clusters, known in the art as a latent image, is generally not visible by ordinary means. Thus, the photosensitive material must be further developed to produce a visible image. This is accomplished by the reduction of silver ions that are in catalytic proximity to silver halide grains bearing the silver-containing clusters of the latent image. This produces a black-and-white image. The non-photosensitive silver source in the exposed areas is catalytically reduced to form the visible black-and-white negative image while the silver halide and the non-photosensitive silver source in the unexposed areas are not reduced.

In photothermographic materials, the reducing agent for the reducible silver ions, often referred to as a "developer," may be any compound that, in the presence of the latent image, can reduce silver ion to metallic silver and is preferably of relatively low activity until it is heated to a temperature sufficient to cause the reaction. A wide variety of classes of compounds have been disclosed in the literature that function as developers for photothermographic materials. At elevated temperatures, the reducible silver ions are reduced by the reducing agent. In photothermographic materials, upon heating, this reaction occurs preferentially in the regions surrounding the latent image. This reaction produces a negative image of metallic silver having a color that ranges from yellow to deep black depending upon the presence of toning agents and other components in the imaging layer(s).

Differences Between Photothermography and Photography

The imaging arts have long recognized that the field of photothermography is clearly distinct from that of photography. Photothermographic materials differ significantly from conventional silver halide photographic materials that require processing with aqueous processing solutions.

As noted above, in photothermographic imaging materials, a visible image is created by heat as a result of the reaction of a developer incorporated within the material. Heating at 50° C. or more is essential for this dry development. In contrast, conventional photographic imaging materials require processing in aqueous processing baths at more moderate temperatures (from 30° C. to 50° C.) to provide a visible image.

In photothermographic materials, only a small amount of silver halide is used to capture light and a non-photosensitive source of reducible silver ions (for example a silver carboxylate) is used to generate the visible image using thermal development. Thus, the imaged photosensitive silver halide serves as a catalyst for the physical development process involving the non-photosensitive source of reducible silver ions and the incorporated reducing agent. In contrast, conventional wet-processed, black-and-white photographic materials use only one form of silver (that is, silver halide) that, upon chemical development, is itself at least partially converted into the silver image, or that upon physical development requires addition of an external silver source (or other reducible metal ions that form black images upon reduction to the corresponding metal). Thus, photothermographic materials require an amount of silver halide per unit area that is only a fraction of that used in conventional wet-processed photographic materials.

In photothermographic materials, all of the "chemistry" for imaging is incorporated within the material itself. For example, such materials include a developer (that is, a reducing agent for the reducible silver ions) while conventional photographic materials usually do not. Even in so-called "instant photography," the developer chemistry is physically separated from the photosensitive silver halide until development is desired. The incorporation of the developer into photothermographic materials can lead to increased formation of various types of "fog" or other undesirable sensitometric side effects. Therefore, much effort has gone into the preparation and manufacture of photothermographic materials to minimize these problems during the preparation of the photothermographic emulsion as well as during coating, use, storage, and post-processing handling.

Moreover, in photothermographic materials, the unexposed silver halide generally remains intact after development and the material must be stabilized against further imaging and development. In contrast, silver halide is removed from conventional photographic materials after solution development to prevent further imaging (that is in the aqueous fixing step).

In photothermographic materials, the binder is capable of wide variation and a number of binders (both hydrophilic and hydrophobic) are useful. In contrast, conventional photographic materials are limited almost exclusively to hydrophilic colloidal binders such as gelatin.

Because photothermographic materials require dry thermal processing, they present distinctly different problems and require different materials in manufacture and use, compared to conventional, wet-processed silver halide photographic materials. Additives that have one effect in conventional silver halide photographic materials may behave quite differently when incorporated in photothermographic materials where the chemistry is significantly more complex. The incorporation of such additives as, for example, stabilizers, antifoggants, speed enhancers, supersensitizers, and spectral and chemical sensitizers in conventional photographic materials is not predictive of whether such additives will prove beneficial or detrimental in photothermographic materials. For example, it is not uncommon for a photographic antifoggant useful in conventional photographic materials to cause various types of fog when incorporated into photothermographic materials, or for supersensitizers that are effective in photographic materials to be inactive in photothermographic materials.

These and other distinctions between photothermographic and photographic materials are described in *Imaging Processes and Materials* (*Neblette's Eighth Edition*), noted above, *Unconventional Imaging Processes*, E. Brinckman et al. (Eds.), The Focal Press, London and New York, 1978, pp. 74–75, in C. Zou et al., *J Imaging Sci. Technol.* 1996, 40, pp. 94–103, and in M. R. V. Sahyun, *J Imaging Sci. Technol.* 1998, 42, 23.

Problem to be Solved

While high-speed color photothermographic films have been described in the art, black-and-white photothermographic systems have not achieved wide use in imaging with UV or visible radiation because of generally low photographic speed.

U.S. Pat. No. 6,423,481 (Simpson et al.) describes the use of combinations of chemical sensitizing compounds to boost the photospeed of black-and-white photothermographic materials.

Moreover, U.S. Pat. No. 6,440,649 (Simpson et al.) describes X-radiation sensitive photothermographic materials containing X-radiation responsive phosphors that provide increased sensitivity (photographic speed). This patent also describes methods of imaging such photothermographic materials.

There is a continuing need for higher-speed aqueous-based black-and-white photothermographic materials.

SUMMARY OF THE INVENTION

This invention provides an aqueous-based black-and-white photothermographic material comprising a support having on at least one side thereof, one or more imaging layers comprising the same or different hydrophilic binders or a water-dispersible latex polymer binders, and in reactive association:

a. a non-photosensitive source of reducible silver ions, b. a reducing agent composition for the reducible silver ions, and c. chemically and spectrally sensitized photosensitive silver halide grains, the photothermographic material having a net $D_{min}$ less than 0.25, and requiring less than 1 erg/cm$^2$ to achieve a density of 1.00 above net $D_{min}$.

This invention also provides an aqueous-based black-and-white photothermographic material comprising a support having on at least one side thereof, one or more imaging layers comprising the same or different hydrophilic binders or water-dispersible latex polymer binders, and in reactive association:

a. a non-photosensitive source of reducible silver ions, b. a reducing agent composition for the reducible silver ions, and c. chemically and spectrally sensitized photosensitive silver iodide or silver bromoiodide grains, the photothermographic material having a net $D_{min}$ less than 0.25, and requiring less than 1 erg/cm$^2$ to achieve a density of 1.00 above net $D_{min}$.

This invention further provides an aqueous-based black-and-white photothermographic material comprising a support having on at least one side thereof, one or more imaging layers comprising the same or different hydrophilic binders or water-dispersible latex polymer binders, and in reactive association:

a. a non-photosensitive source of reducible silver ions, b. a reducing agent composition for said reducible silver ions, and c. chemically sensitized photosensitive silver bromide, silver iodide, or silver bromoiodide tabular grains, the tabular grains having an average thickness of at least 0.02 μm and up to and including 0.10 μm, an equivalent circular diameter of at least 0.5 μM and up to and including 8 μm, and an aspect ratio of at least 5:1.

This invention still further provides an aqueous-based black-and-white photothermographic material comprising a support having on both sides thereof, one or more of the same or different imaging layers comprising the same or different hydrophilic binders or water-dispersible latex polymer binders, and in reactive association:

a. a non-photosensitive source of reducible silver ions that includes a silver benzotriazole, b. a reducing agent composition for the reducible silver ions that is an ester of ascorbic acid, and c. chemically and spectrally sensitized preformed photosensitive tabular silver bromoiodide grains, the photothermographic material having a net $D_{min}$ less than 0.25, and requiring less than 1 erg/cm$^2$ to achieve a density of 1.00 above net $D_{min}$.

A method of forming a visible image comprises:

A) imagewise exposing a photothermographic material of this invention to electromagnetic radiation in the range of from about 300 to about 1180 nm to form a latent image, and B) simultaneously or sequentially, heating the exposed photothermographic material to develop the latent image into a visible image.

In some embodiments, wherein the photothermographic material comprises a transparent support, and the image-forming method further comprises:

C) positioning the exposed and heat-developed photothermographic material with the visible image thereon, between a source of imaging radiation and an imageable material that is sensitive to the imaging radiation, and D) exposing the imageable material to the imaging radiation through the visible image in the exposed and heat-developed photothermographic material to provide an image in the imageable material.

This invention also provides preferred embodiments that are "double sided" photothermographic materials having one or more of the same or different thermally developable imaging layers on both sides of the support.

The imaging method of this invention is advantageously carried out using an imaging assembly of this invention comprising an aqueous-based black-and-white photothermographic material of this invention that is arranged in association with one or more phosphor intensifying screens.

Thus, in some embodiments of the present invention an imaging assembly comprises:

A) an aqueous-based black-and-white photothermographic material comprising a support having on both sides thereof, one or more of the same or different imaging layers comprising the same or different hydrophilic binders or water-dispersible latex polymer binders, and in reactive association:

a. a non-photosensitive source of reducible silver ions, b. a reducing agent composition for the reducible silver ions, and c. chemically and spectrally sensitized photosensitive silver halide grains, the photothermographic material having a net $D_{min}$ less than 0.25, and requiring less than 1 erg/cm$^2$ to achieve a density of 1.00 above net $D_{min}$, and B) the photothermographic material being arranged in association with one or more phosphor intensifying screens.

The aqueous-based black-and-white photothermographic materials of this invention have a net $D_{min}$ less than 0.25, and require less than 1 erg/cm$^2$ to achieve a density of 1.00 above net $D_{min}$ and preferably have a net $D_{min}$ less than 0.21, and require less than 0.6 ergs/cm$^2$ to achieve a density of 1.00 above net $D_{min}$. There are various ways for achieving this increased photospeed as described below, including the use of the preferred photosensitive "ultrathin" tabular silver halide grains as well as various combinations of chemical sensitizing compounds, toners, thermal solvents, or various combinations of these features. In addition, speed can be increased in some embodiments by using the photothermographic material in combination with a phosphor intensifying screen whereby the radiation from the phosphor is used to image the photothermographic material. Speed (or sensitivity) is measured at a practical density above net $D_{min}$ because while the photothermographic material may have an intrinsic sensitivity, if an image with a practical density above net $D_{min}$ cannot be obtained, for useful purposes, the speed cannot be measured.

DETAILED DESCRIPTION OF THE INVENTION

The photothermographic materials of this invention can be used in black-and-white photothermography and in electronically generated black-and-white hardcopy recording. They can be used in microfilm applications, in radiographic imaging (for example digital medical imaging), in X-ray radiography, and industrial radiography.

The materials of this invention can be made to be sensitive to radiation from UV to IR, that is from about 100 to about 1400 nm (preferably from about 350 to about 1180 nm). The photosensitive silver halide used in these materials has intrinsic sensitivity to blue light and to X-radiation. Increased sensitivity to a particular region of the spectrum is imparted through the use of various spectral sensitizing dyes adsorbed to the silver halide grains.

The photothermographic materials of this invention are particularly useful for medical imaging of human or animal subjects in response to visible radiation for example in order to provide medical diagnoses. Such applications include, but are not limited to, thoracic imaging, mammography, dental imaging, orthopedic imaging, general medical radiography, therapeutic radiography, veterinary radiography, and autoradiography. The photothermographic materials of this invention may be used in combination with one or more phosphor intensifying screens and thereby have the appropriate sensitivity to the radiation emitted from the screens. The materials of this invention are also useful for non-medical uses of visible or X-radiation (such as X-ray lithography and industrial radiography).

For some applications it may be useful that the photothermographic materials be "double sided" and have photothermographic imaging layer(s) on both sides of the support.

In the photothermographic materials of this invention, the components needed for imaging can be in one or more thermally developable layers. The layer(s) that contain the photosensitive silver halide or non-photosensitive source of reducible silver ions, or both, are referred to herein as "thermally developable layers", "imaging layers", or "photothermographic emulsion layer(s)." The photosensitive silver halide and the non-photosensitive source of reducible silver ions are in catalytic proximity (that is, in reactive association with each other) and preferably are in the same emulsion layer. "Catalytic proximity" or "reactive association" means that they should be in the same layer or in adjacent layers.

Where the materials contain imaging layers on one side of the support only, various non-imaging layers are usually disposed on the "backside" (non-emulsion side) of the materials, including antihalation layer(s), protective layers, antistatic layers, conductive layers, and transport enabling layers.

In such instances, various non-imaging layers can also be disposed on the "frontside" or emulsion side of the support, including protective topcoat layers, primer layers, interlayers, opacifying layers, antistatic layers, conductive layers, antihalation layers, acutance layers, auxiliary layers, and other layers readily apparent to one skilled in the art.

If the photothermographic materials comprise one or more thermally developable imaging layers on both sides of the support, each side can also include one or more protective topcoat layers, primer layers, interlayers, antistatic layers, conductive layers, acutance layers, auxiliary layers, crossover control layers, and other layers readily apparent to one skilled in the art.

When the photothermographic materials of this invention are thermally developed as described below in a substantially water-free condition after, or simultaneously with, imagewise exposure, a black-and-white silver image is obtained.

Definitions

As used herein:

In the descriptions of the photothermographic materials of the present invention, "a" or "an" component refers to "at least one" of that component (for example silver halide or chemical sensitizers).

Heating in a substantially water-free condition as used herein, means heating at a temperature of from about 50° C. to about 250° C. with little more than ambient water vapor present. The term "substantially water-free condition" means that the reaction system is approximately in equilibrium with water in the air and water for inducing or promoting the reaction is not particularly or positively supplied from the exterior to the material. Such a condition is described in T. H. James, *The Theory of the Photographic Process*, Fourth Edition, Eastman Kodak Company, Rochester, N.Y., 1977, p. 374.

"Photothermographic material(s)" means a construction comprising at least one photothermographic emulsion layer or a photothermographic set of layers (wherein the silver halide and the source of reducible silver ions are in one layer and the other essential components or desirable additives are distributed, as desired, in an adjacent coating layer) and any supports, topcoat layers, image-receiving layers, antistatic layers, conductive layers, blocking layers, antihalation layers, subbing or priming layers. These materials also include multilayer constructions in which one or more imaging components are in different layers, but are in "reactive association" so that they readily come into contact with each other during imaging and/or development. For example, one layer can include the non-photosensitive source of reducible silver ions and another layer can include the reducing agent composition, but the two reactive components are in reactive association with each other.

"Photocatalyst" means a photosensitive compound such as silver halide that, upon exposure to radiation, provides a compound that is capable of acting as a catalyst for the subsequent development of the image-forming material.

"Catalytic proximity" or "reactive association" means that the materials are in the same layer or in adjacent layers so that they readily come into contact with each other during thermal imaging and development.

"Emulsion layer," "imaging layer," "thermally developable imaging layer," or "photothermographic emulsion layer," means a layer of a photothermographic material that contains the photosensitive silver halide and/or non-photosensitive source of reducible silver ions. It can also mean a layer of the photothermographic material that contains, in addition to the photosensitive silver halide and/or non-photosensitive source of reducible ions, additional essential components and/or desirable additives. These layers are usually on what is known as the "frontside" of the support, but in some embodiments, they are present on both sides of the support. Such embodiments are known as "double-sided" photothermographic materials. In such double-sided materials the layers can be of the same or different chemical composition, thickness, or sensitometric properties.

"Ultraviolet region of the spectrum" refers to that region of the spectrum less than or equal to 410 nm, and preferably from about 100 nm to about 410 nm, although parts of these ranges may be visible to the naked human eye. More preferably, the ultraviolet region of the spectrum is the region of from about 190 to about 405 nm.

"Visible region of the spectrum" refers to that region of the spectrum of from about 400 nm to about 700 nm.

"Short wavelength visible region of the spectrum" refers to that region of the spectrum of from about 400 nm to about 450 nm.

"Red region of the spectrum" refers to that region of the spectrum of from about 600 nm to about 700 nm.

"Infrared region of the spectrum" refers to that region of the spectrum of from about 700 nm to about 1400 nm.

"Non-photosensitive" means intentionally neither light nor radiation sensitive.

The sensitometric terms "absorbance," "contrast," $D_{min}$, and $D_{max}$ have conventional definitions known in the imaging arts. Particularly, $D_{min}$ is considered herein as image density achieved when the photothermographic material is thermally developed without prior exposure to radiation. "Net $D_{min}$" is considered herein as image density achieved when the photothermographic material is thermally developed without prior exposure to radiation minus the density of the support and of any colorants, pigments, antihalation, or acutance dyes.

The photographic speed (or sensitivity) of the photothermographic materials of this invention is defined using the energy in ergs/cm$^2$ required to achieve a specified density (1.00) above net $D_{min}$ using the method defined further herein. In general, the speed is measured after the photothermographic material has been imaged and heat developed at 150° C. for either 15 or 25 seconds to provide the specified density.

"Transparent" means capable of transmitting visible light or imaging radiation without appreciable scattering or absorption.

"Haze" is wide-angle scattering that diffuses light uniformly in all directions, wherein the light intensity per angle is small. Haze reduces contrast and results in a milky or cloudy appearance. Haze is the percentage of transmitted light that deviates from the incident beam by more than 2.5 degrees on the average. The lower the haze number, the less hazy the material.

The term "equivalent circular diameter" (ECD) is used to define the diameter (μm) of a circle having the same projected area as a silver halide grain.

The term "aspect ratio" is used to define the ratio of grain ECD to grain thickness.

The term "tabular grain" is used to define a silver halide grain having two parallel crystal faces that are clearly larger than any remaining crystal faces and having an aspect ratio of at least 2. The term "tabular grain emulsion" herein refers to an imaging emulsion containing silver halide grains in which the tabular grains account for more than 70% of the total photosensitive silver halide grain projected area.

The term "double sided" is used to define photothermographic materials having one or more of the same or different thermally developable emulsion layers disposed on both sides (front and back) of the support. Another term for double-sided is "duplitized".

In the compounds described herein with structures, no particular double bond geometry (for example, cis or trans) is intended by the structures drawn. Similarly, alternating single and double bonds and localized charges are drawn as a formalism. In reality, both electron and charge delocalization exists throughout the conjugated chain.

As is well understood in this art, for all organic compounds herein described, substitution is not only tolerated, but is often advisable and various substituents are anticipated on the compounds used in the present invention unless otherwise stated. Thus, when a compound is referred to as "having the structure" of a given formula, any substitution that does not alter the bond structure of the formula or the shown atoms within that structure is included within the formula, unless such substitution is specifically excluded by language (such as "free of carboxy-substituted alkyl"). For example, where a benzene ring structure is shown (including fused ring structures), substituent groups may be placed on the benzene ring structure, but the atoms making up the benzene ring structure may not be replaced.

As a means of simplifying the discussion and recitation of certain substituent groups, the term "group" refers to chemical species that may be substituted as well as those that are not so substituted. Thus, the term "group," such as "alkyl group" is intended to include not only pure hydrocarbon alkyl chains, such as methyl, ethyl, n-propyl, t-butyl, cyclohexyl, iso-propyl, and octadecyl, but also alkyl chains bearing substituents known in the art, such as hydroxyl, alkoxy, phenyl, halogen atoms (F, Cl, Br, and I), cyano, nitro, amino, and carboxy. For example, alkyl group includes ether and thioether groups (for example $CH_3$—$CH_2$—$CH_2$—O—$CH_2$— and $CH_3$—$CH_2$—$CH_2$—S—$CH_2$—), haloalkyl, nitroalkyl, alkylcarboxy, carboxyalkyl, carboxamido, hydroxyalkyl, sulfoalkyl, and other groups readily apparent to one skilled in the art. Substituents that adversely react with other active ingredients, such as very strongly electrophilic or oxidizing substituents, would, of course, be excluded by the ordinarily skilled artisan as not being inert or harmless.

*Research Disclosure* is a publication of Kenneth Mason Publications Ltd., Dudley House, 12 North Street, Emsworth, Hampshire PO10 7DQ England (also available from Emsworth Design Inc., 147 West 24th Street, New York, N.Y. 10011).

Other aspects, advantages, and benefits of the present invention are apparent from the detailed description, examples, and claims provided in this application.

The Photosensitive Silver Halide

The photothermographic materials of the present invention include one or more photosensitive silver halides. Useful silver halides include silver bromide, silver iodide, silver bromoiodide, silver chlorobromoiodide, silver chlorobromide and others readily apparent to one skilled in the art. Preferably, silver bromoiodide is used in which any suitable amount of iodide is present up to almost 100 mol % iodide. More preferably, the silver bromoiodide comprises at least 70 mole % (preferably at least 85 mole % and more preferably at least 90 mole %) bromide (based on total silver halide). The remainder of the halide is either iodide or chloride, or both. Preferably, the additional halide is iodide.

The shape of the photosensitive silver halide grains used in the present invention is in no way limited. The silver halide grains may have any crystalline habit including, but not limited to, cubic, octahedral, tetrahedral, orthorhombic, rhombic, dodecahedral, other polyhedral, tabular, laminar, twinned, or platelet morphologies and may have epitaxial growth of crystals thereon. If desired, a mixture of these crystals can be employed.

However, in preferred embodiments, at least 70% (preferably from about 85% to 100%) of the total photosensitive silver halide grain projected area in each emulsion used in the invention are tabular silver halide grains having an aspect ratio of at least 5. The remainder of the silver halide grains can have any suitable crystalline habit as described above and may have epitaxial growth of crystals thereon. Most preferably, substantially all of the silver halide grains have tabular morphology.

The preferred tabular silver halide grains used in the practice of this invention are advantageous because they are considered "ultrathin" and have an average thickness of at least 0.02 μm and up to and including 0.10 μm. Preferably, they have an average thickness of at least 0.03 μm and more preferably of at least 0.04 μm, and up to and including 0.08 μm and more preferably up to and including 0.07 μm.

In addition, these tabular grains have an ECD of at least 0.5 μm, preferably at least 0.75 μm, and more preferably at least 1.0 μm. The ECD can be up to and including 8 μm, preferably up to and including 6 μm, and more preferably up to and including 4 μm.

The aspect ratio of the useful tabular grains is at least 5:1, preferably at least 10:1, and more preferably at least 15:1. For practical purposes, the tabular grain aspect ratio is generally up to 100:1. An aspect ratio of between about 30:1 and about 70:1 is particularly useful.

Grain size may be determined by any of the methods commonly employed in the art for particle size measurement. Representative methods are described, for example, in "Particle Size Analysis," ASTM Symposium on Light Microscopy, R. P. Loveland, 1955, pp. 94–122, and in C. E. K. Mees and T. H. James, *The Theory of the Photographic Process*, Third Edition, Macmillan, New York, 1966, Chapter 2. Particle size measurements may be expressed in terms of the projected areas of grains or approximations of their diameters. These will provide reasonably accurate results if the grains of interest are substantially uniform in shape. In the Examples below, the grain sizes referred to were determined using well-known electron microscopy techniques such as Transmission Electron Microscopy (TEM) or Scanning Electron Microscopy (SEM).

The high aspect ratio tabular silver halide grains useful in the present invention generally have a uniform ratio of halide throughout. However, they may have a graded halide content, with a continuously varying ratio of, for example, silver bromide and silver iodide or they may be of the core-shell type, having a discrete core of one halide ratio, and one or more discrete shells of another halide ratio. For example, the central regions of the tabular grains may contain at least 1 mol % more iodide than outer or annular regions of the grains. Core-shell silver halide grains useful in photothermographic materials and methods of preparing these materials are described for example in U.S. Pat. No. 5,382,504 (Shor et al.), incorporated herein by reference. Iridium and/or copper doped core-shell and non-core-shell grains are described in U.S. Pat. No. 5,434,043 (Zou et al.) and U.S. Pat. No. 5,939,249 (Zou), both incorporated herein by reference.

The silver halide grains can also be doped using one or more of the conventional metal dopants known for this purpose including those described in *Research Disclosure* September 1996, Item 38957, and U.S. Pat. No. 5,503,970 (Olm et al.), incorporated herein by reference. Preferred dopants include iridium (3+ or 4+) and ruthenium (2+ or 3+) salts.

The silver halide grains can be added to (or formed within) the emulsion layer(s) in any fashion as long as it is placed in catalytic proximity to the non-photosensitive source of reducible silver ions.

It is preferred that the silver halide grains be preformed and prepared by an ex-situ process. The silver halide grains prepared ex-situ may then be added to and physically mixed with the non-photosensitive source of reducible silver ions.

The source of reducible silver ions may also be formed in the presence of ex-situ-prepared silver halide grains. In this process, the source of reducible silver ions, is formed in the presence of these preformed silver halide grains. Co-precipitation of the reducible source of silver ions in the presence of silver halide provides a more intimate mixture of the two materials [see, for example U.S. Pat. No. 3,839,049 (Simons)]. Materials of this type are often referred to as "preformed soaps."

Mixing of the silver halide grains prepared ex-situ with the non-photosensitive silver source can also be carried out during the coating step using, for example, in-line mixing techniques.

Preformed grain silver halide emulsions used in the material of this invention can be prepared by aqueous or organic processes and can be unwashed or washed to remove soluble salts. In the latter case, the soluble salts can be removed by ultrafiltration, by chill setting and leaching, or by washing the coagulum [for example, by the procedures described in U.S. Pat. No. 2,618,556 (Hewitson et al.), U.S. Pat. No. 2,614,928 (Yutzy et al.), U.S. Pat. No. 2,565,418 (Yackel), U.S. Pat. No. 3,241,969 (Hart et al.), and U.S. Pat. No. 2,489,341 (Waller et al.)].

Additional methods of preparing these silver halide and organic silver salts and manners of blending them are described in *Research Disclosure*, June 1978, Item 17029, U.S. Pat. No. 3,700,458 (Lindholm) and U.S. Pat. No. 4,076,539 (Ikenoue et al.), and JP Applications 13224/74, 42529/76, and 17216/75.

In some instances, it may be helpful to prepare the photosensitive silver halide grains in the presence of a hydroxytetrazindene (such as 4-hydroxy-6-methyl-1,3,3a,7-tetrazaindene) or a N-heterocyclic compound comprising at least one mercapto group (such as 1-phenyl-5-mercaptotetrazole). Details of this procedure are provided in copending and commonly assigned U.S. Pat. No. 6,413,710, which is incorporated herein by reference.

A useful method of preparing the preferred "ultrathin" tabular silver halide grains useful in the practice of this invention are exemplified below just prior to the Examples.

In addition to the preformed silver halide grains, it is also effective to use an in-situ process in which a halide-containing compound is added to an organic silver salt to partially convert some of the silver of the organic silver salt to silver halide. The halogen-containing compound can be inorganic (such as zinc bromide or lithium bromide) or organic (such as N-bromosuccinimide)

The one or more light-sensitive silver halides used in the photothermographic materials of the present invention are preferably present in an amount of from about 0.005 to about 0.5 mole, more preferably from about 0.05 to about 0.30 mole, and most preferably from about 0.01 to about 0.25 mole, per mole of non-photosensitive source of reducible silver ions.

Chemical Sensitizers

The photosensitive silver halides used in the present invention are chemically sensitized with one or more chemical sensitizing agents such as compounds containing sulfur, selenium, or tellurium, a compound containing gold, platinum, palladium, iron, ruthenium, rhodium, or iridium, a reducing agent such as a tin halide, to provide increased photospeed. The details of these procedures are described in T. H. James, *The Theory of the Photographic Process*, Fourth Edition, Eastman Kodak Company, Rochester, N.Y., 1977, Chapter 5, pages 149 to 169, U.S. Pat. No. 1,623,499 (Sheppard et al.), U.S. Pat. No. 2,399,083 (Waller et al.), U.S. Pat. No. 3,297,447 (McVeigh), U.S. Pat. No. 3,297,446 (Dunn), U.S. Pat. No. 5,049,485 (Deaton), U.S. Pat. No. 5,252,455 (Deaton), U.S. Pat. No. 5,391,727 (Deaton), U.S. Pat. No. 5,912,111 (Lok et al.), U.S. Pat. No. 5,759,761 (Lushington et al.), U.S. Pat. No. 5,945,270 (Lok et al.), U.S. Pat. No. 6,159,676 (Lin et al), and U.S. Pat. No. 6,296,998 (Eikenberry et al).

In addition, tabular silver halide grains comprising sensitizing dye(s), silver salt epitaxial deposits, and addenda that include a mercaptotetrazole and a tetraazindene may be chemically sensitized. Such emulsions are described in U.S. Pat. No. 5,691,127 (Daubendiek et al.), incorporated herein by reference, Sulfur sensitization is performed by adding a sulfur sensitizer and stirring the emulsion at a temperature as high as 40° C. or above for a predetermined time. In addition to the sulfur compound contained in gelatin, various sulfur compounds can be used. Some examples of sulfur sensitizers include thiosulfates (for example, hypo), thioureas (for example, diphenylthiourea, triethylthiourea, N-ethyl-N'-(4-methyl-2-thiazolyl)thiourea and certain tetra-substituted thioureas known as "rapid sulfiding agents"), thioamides (for example, thioacetamide), rhodanines (for example, diethylrhodanine and 5-benzylidene-N-ethylrhodanine), phosphine sulfides (for example, trimethylphosphine sulfide), thiohydantoins, 4-oxo-oxazolidine-2-thiones, dipolysulfides (fox example, dimorpholine disulfide, cystine and hexathiocane-thione), mercapto compounds (for example, cystein), polythionates, and elemental sulfur.

Rapid sulfiding agents are also useful in the present invention. Particularly useful are the tetrasubstituted middle chalcogen thiourea compounds described, for example in U.S. Pat. No. 6,296,998 (Eikenberry et al.), and U.S. Pat. No. 6,322,961 (Lam et al.), both noted above, and represented below by Structure RS-1:

(RS-1)

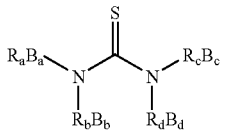

wherein each $R_a$, $R_b$, $R_c$, and $R_d$ group independently represents an alkylene, cycloalkylene, carbocyclic arylene, heterocyclic arylene, alkarylene or aralkylene group, or taken together with the nitrogen atom to which they are attached, $R_a$ and $R_b$ or $R_c$ and $R_d$ can complete a 5- to 7-membered heterocyclic ring, and each of the $B_a$, $B_b$, $B_c$, and $B_d$ groups independently is hydrogen or represents a carboxylic, sulfinic, sulfonic, hydroxamic, mercapto, sulfonamido or primary or secondary amino nucleophilic group, with the proviso that at least one of the $R_aB_a$ through $R_dB_d$ groups contains the nucleophilic group bonded to a urea nitrogen atom through a 1- or 2-membered chain. Tetrasubstituted middle chalcogen ureas of such formula are disclosed in U.S. Pat. No. 4,810,626 (Burgmaier et al.), the disclosure of which is here incorporated by reference.

A preferred group of rapid sulfiding agents has the general structure RS-1 wherein each of the $R_a$, $R_b$, $R_c$, and $R_d$ groups independently represents an alkylene group having 1 to 6 carbon atoms, and each of the $B_a$, $B_b$, $B_c$, and $B_d$ groups independently is hydrogen or represents a carboxylic, sulfinic, sulfonic, hydroxamic group, with the proviso that at least one of the $R_aB_a$ through $R_4B_4$ groups contains the nucleophilic group bonded to a urea nitrogen atom through a 1- or 2-membered chain. Especially preferred rapid sulfiding agents are represented by Structures RS-1a and RS-1b:

(RS-1a)

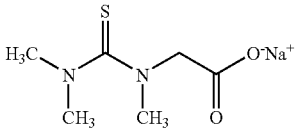

(RS-1b)

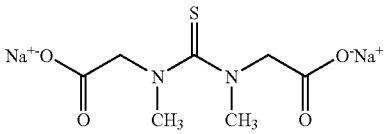

These compounds have been shown to be very effective sensitizers under mild digestion conditions and to produce higher speeds than many other thiourea compounds that lack the specified nucleophilic substituents.

The amount of the sulfur sensitizer to be added varies depending upon various conditions such as pH, temperature and grain size of silver halide at the time of chemical ripening, it is preferably from $10^{-7}$ to $10^{-2}$ mole per mole of silver halide, and more preferably from $10^{-5}$ to $10^{-3}$ mole.

Selenium sensitization is performed by adding a selenium compound and stirring the emulsion at a temperature at least 40° C. for a predetermined time. Examples of the selenium sensitizers include colloidal selenium, selenoureas (for example, N,N-dimethylselenourea, trifluoromethyl-carbonyl-trimethylselenourea and acetyl-trimethylselenourea), selenoamides (for example, selenoacetamide and N,N-diethylphenylselenoamide), phosphine selenides (for example, triphenylphosphine selenide and pentafluorophenyl-triphenylphosphine selenide, and methylene-bis[diphenyl-phosphine selenide), selenophoshpates (for example, tri-p-tolyl-selenophosphate and tri-n-butyl seleno-phosphate), selenoketones (for example, selenobenzophenone), isoselenocyanates, selenocarboxylic acids, selenoesters and diacyl selenides. Other selenium compounds such as selenious acid, potassium selenocyanate, selenazoles, and selenides can also be used as selenium sensitizers. Some specific examples of useful selenium compounds can be found in U.S. Pat. No. 5,158,892 (Sasaki et al.), U.S. Pat. No. 5,238,807 (Sasaki et al.), and 5,942,384 (Arai et al.). Still other useful selenium sensitizers are those described in U.S. Pat. No. 6,620,577 (Lynch et al.), incorporated herein by reference.

Tellurium sensitizers for use in the present invention are compounds capable of producing silver telluride, which is presumed to serve as a sensitization nucleus on the surface or inside of silver halide grain. Examples of the tellurium sensitizers include telluroureas (for example, tetramethyltellurourea, N,N-dimethylethylene-tellurourea and N,N'-diphenylethylenetellurourea), phosphine tellurides (for example, butyl-diisopropylphosphine telluride, tributylphosphine telluride, tributoxyphosphine telluride and ethoxy-diphenylphosphine telluride), diacyl ditellurides and diacyl tellurides [for example, bis(diphenylcarbamoyl ditelluride, bis(N-phenyl-N-methylcarbamoyl) ditelluride, bis (N-phenyl-N-methylcarbamoyl) telluride and bis(ethoxycarbonyl telluride)], isotellurocyanates, telluroamides, tellurohydrazides, telluroesters (such as butyl hexyl telluroester), telluroketones (such as telluroacetophenone), colloidal tellurium, (di)tellurides and other tellurium compounds (for example, potassium telluride and sodium telluropentathionate). Tellurium compounds for use as chemical sensitizers can be selected from those described in *J. Chem. Soc,. Chem. Commun.* 1980, 635, ibid., 1979, 1102, ibid., 1979, 645, *J. Chem. Soc. Perkin. Trans,* 1980, 1, 2191, *The Chemistry of Organic Selenium and Tellurium Compounds*, S. Patai and Z. Rappoport, Eds., Vol. 1 (1986), and Vol. 2 (1987) and U.S. Pat. No. 5,677,120 (Lushington et al.). Preferred tellurium-containing chemical sensitizers are those described in U.S. Published Patent Application 2002/0164549 (Lynch et al.), and U.S. Pat. No. 6,733,959 (Gysling et al.), both incorporated herein by reference.

Specific examples thereof include the compounds described in U.S. Pat. No. 1,623,499 (Sheppard et al.), U.S. Pat. No. 3,320,069 (Illingsworth), U.S. Pat. No. 3,772,031 (Berry et al.), U.S. Pat. No. 5,215,880 (Kojima et al.), U.S. Pat. No. 5,273,874 (Kojima et al.), U.S. Pat. No. 5,342,750 (Sasaki et al.), British Patent 235,211 (Sheppard), British Patent 1,121,496 (Halwig), British Patent 1,295,462 (Hilson et al.) and British Patent 1,396,696 (Simons), and JP-04-271341 A (Morio et al.).

The amount of the selenium or tellurium sensitizer used in the present invention varies depending on silver halide grains used or chemical ripening conditions. However, it is generally from $10^{-8}$ to $10^{-2}$ mole per mole of silver halide, preferably on the order of from $10^{-7}$ to $10^{-3}$ mole. The conditions for chemical sensitization in the present invention are not particularly restricted. However, in general, pH is from 5 to 8, pAg is from 6 to 11, preferably from 7 to 10, and temperature is from 40 to 95° C., preferably from 45 to 85° C.

Noble metal sensitizers for use in the present invention include gold, platinum, palladium and iridium. Gold sensitization is particularly preferred.

The gold sensitizer used for the gold sensitization of the silver halide emulsion used in the present invention may have an oxidation number of 1 or 3, and may be a gold compound commonly used as a gold sensitizer. Examples thereof include chloroauric acid, potassium chloroaurate, auric trichloride, potassium dithiocyanatoaurate, $[AuS_2P(i\text{-}C_4H_9)_2]_2$, bis-(1,4,5-trimethyl-1,2,4-triazolium-3-thiolate) gold (I) tetrafluoroborate, and pyridyltrichloro gold. U.S. Pat. No. 5,858,637 (Eshelman et al.) describes various Au (I) compounds that can be used as chemical sensitizers. Other useful gold compounds can be found in U.S. Pat. No. 5,759,761 (Lushington et al.).

Useful combinations of gold (I) complexes and rapid sulfiding agents are described in U.S. Pat. No. 6,322,961 (Lam et al.). Combinations of gold (III) compounds and either sulfur or tellurium compounds are particularly useful as chemical sensitizers and are described in U.S. Pat. No. 6,423,481 (noted above), incorporated herein by reference.

Production or physical ripening processes for the silver halide grains used in emulsions of the present invention may be performed under the presence of cadmium salts, sulfites, lead salts, or thallium salts.

Reduction sensitization may also be used. Specific examples of compounds useful in reduction sensitization include, but are not limited to, stannous chloride, hydrazine ethanolamine, and thioureaoxide. Reduction sensitization may be performed by ripening the grains while keeping the emulsion at pH 7 or above, or at pAg 8.3 or less. Also, reduction sensitization may be performed by introducing a single addition portion of silver ion during the formation of the grains.

Chemical sensitization can also be provided by oxidative decomposition of certain sulfur-containing spectral sensitizing dyes on or around the silver halide grains, as described for example in U.S. Pat. No. 5,891,615 (Winslow et al.), incorporated herein by reference. Such oxidative decomposition is generally carried out in the presence of suitable strong oxidizing agent (such as hydrobromic acid salts of nitrogen-containing heterocycles, for example pyridinium perbromide hydrobromide) at a temperature up to 40° C. so as to form a species that acts as the chemical sensitizer on the silver halide grains. A variety of such sensitizing dyes are known but the preferred classes of compounds contain a thiohydantoin, rhodanine, or 2-thio-4-oxo-oxazolidine nucleus. Representative compounds of this type are described as Compounds CS-1 through CS-12 in the noted Winslow et al. patent.

Spectral Sensitizers

It is also desirable to add spectral sensitizing dyes to enhance silver halide sensitivity to ultraviolet, visible, and/or infrared radiation (for example from about 300 to about 1180 nm). Thus, the photosensitive silver halides may be spectrally sensitized with various dyes that are known to spectrally sensitize silver halide. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. Cyanine dyes, merocyanine dyes and complex merocyanine dyes are particularly useful. Spectral sensitization within a wavelength of from about 350 to about 850 nm is particularly useful.

Suitable sensitizing dyes such as those described in U.S. Pat. No. 3,719,495 (Lea), U.S. Pat. No. 4,396,712 (Kinoshita et al.), U.S. Pat. No. 4,690,883 (Kubodera et al.), U.S. Pat. No. 4,840,882 (Iwagaki et al.), U.S. Pat. No. 5,064,753 (Kohno et al.), U.S. Pat. No. 5,281,515 (Delprato et al.), U.S. Pat. No. 5,393,654 (Burrows et al.), U.S. Pat. No. 5,441,866 (Miller et al.), U.S. Pat. No. 5,508,162 (Dankosh), U.S. Pat. No. 5,510,236 (Dankosh), U.S. Pat. No. 5,541,054 (Miller et al.), JP 2000-063690 (Tanaka et al.), JP 2000-112054 (Fukusaka et al.), JP 2000-273329 (Tanaka et al.), JP 2001-005145 (Arai), JP 2001-064527 (Oshiyama et al.), and JP 2001-154305 (Kita et al.), can be used in the practice of the invention. All of the publications noted above are incorporated herein by reference.

A summary of generally useful spectral sensitizing dyes is contained in *Research Disclosure*, Item 308119, Section IV, December, 1989. Additional teaching relating to specific combinations of spectral sensitizing dyes also include U.S. Pat. No. 4,581,329 (Sugimoto et al.), U.S. Pat. No. 4,582,786 (Ikeda et al.), U.S. Pat. No. 4,609,621 (Sugimoto et al.), U.S. Pat. No. 4,675,279 (Shuto et al.), U.S. Pat. No. 4,678,741 (Yamada et al.), U.S. Pat. No. 4,720,451 (Shuto et al.), U.S. Pat. No. 4,818,675 (Miyasaka et al.), U.S. Pat. No. 4,945,036 (Arai et al.), and U.S. Pat. No. 4,952,491 (Nishikawa et al.). Additional classes of dyes useful for spectral sensitization, including sensitization at other wavelengths are described in *Research Disclosure*, 1994, Item 36544, section V. All of the above references and patents above are incorporated herein by reference.

Also useful are spectral sensitizing dyes that decolorize by the action of light or heat. Such dyes are described in U.S. Pat. No. 4,524,128 (Edwards et al.), JP 2001-109101 (Adachi), JP 2001-154305 (Kita et al.), and JP 2001-183770 (Hanyu et al.).

Spectral sensitizing dyes are chosen for optimum photosensitivity, stability, and synthetic ease. They may be added before, after, or during the chemical finishing of the photothermographic emulsion. One useful spectral sensitizing dye for the photothermographic materials of this invention is anhydro-5-chloro-3,3'-di-(3-sulfopropyl)naphtho[1,2-d] thiazolothiacyanine hydroxide, triethylammonium salt.

Spectral sensitizing dyes may be used singly or in combination. When used singly or in combination, the dyes are selected for the purpose of adjusting the wavelength distribution of the spectral sensitivity, and for the purpose of supersensitization. When using a combination of dyes having a supersensitizing effect, it is possible to attain much higher sensitivity than the sum of sensitivities that can be achieved by using each dye alone. It is also possible to attain such supersensitizing action by the use of a dye having no spectral sensitizing action by itself, or a compound that does not substantially absorb visible light. Diaminostilbene compounds are often used as supersensitizers.

An appropriate amount of spectral sensitizing dye added is generally about $10^{-10}$ to $10^{-1}$ mole, and preferably, about $10^{-7}$ to $10^{-2}$ mole per mole of silver halide.

Non-Photosensitive Source of Reducible Silver Ions

The non-photosensitive source of reducible silver ions used in photothermographic materials of this invention can be any organic compound that contains reducible silver (1+) ions. Preferably, it is a silver salt or coordination complex that is comparatively stable to light and forms a silver image when heated to 50° C. or higher in the presence of an exposed silver halide and a reducing agent composition.

Silver salts of nitrogen-containing heterocyclic compounds are preferred, and one or more silver salts of compounds containing an imino group are particularly preferred. Representative compounds of this type include, but are not limited to, silver salts of benzotriazole and substituted derivatives thereof (for example, silver methylbenzotriazole and silver 5-chlorobenzotriazole), silver salts of 1,2,4-triazoles or 1-H-tetrazoles such as phenylmercaptotetrazole as described in U.S. Pat. No. 4,220,709 (deMauriac), and silver salts of imidazoles and imidazole derivatives as described in U.S. Pat. No. 4,260,677 (Winslow et al.). Particularly useful silver salts of this type are the silver salts of benzotriazole, substituted derivatives thereof, or mixtures of two or more of these salts. A silver salt of benzotriazole is most preferred in the photothermographic emulsions and materials of this invention.

Silver salts of compounds containing mercapto or thione groups and derivatives thereof can also be used. Preferred compounds of this type include a heterocyclic nucleus containing 5 or 6 atoms in the ring, at least one of which is a nitrogen atom, and other atoms being carbon, oxygen, or sulfur atoms. Such heterocyclic nuclei include, but are not limited to, triazoles, oxazoles, thiazoles, thiazolines, imidazoles, diazoles, pyridines, and triazines. Representative examples of these silver salts include, but are not limited to, a silver salt of 3-mercapto-4-phenyl-1,2,4-triazole, a silver salt of 2-mercaptobenzimidazole, a silver salt of 2-mercapto-5-aminothiadiazole, a silver salt of 2-(2-ethylglycolamido)benzothiazole, a silver salt of 5-carboxylic-1-methyl-2-phenyl-4-thiopyri-dine, a silver salt of mercaptotriazine, a silver salt of 2-mercaptobenzoxazole, silver salts as described in U.S. Pat. No. 4,123,274 (Knight et al.) (for example, a silver salt of a 1,2,4-mercaptothiazole derivative, such as a silver salt of 3-amino-5-benzylthio-1,2,4-thiazole), and a silver salt of thione compounds [such as a silver salt of 3-(2-carboxyethyl)-4-methyl-4-thiazoline-2-thione as described in U.S. Pat. No. 3,785,830 (Sullivan et al.)]. Examples of other useful silver salts of mercapto or thione substituted compounds that do not contain a heterocyclic nucleus include but are not limited to, a silver salt of thioglycolic acids such as a silver salt of an S-alkylthioglycolic acid (wherein the alkyl group has from 12 to 22 carbon atoms), a silver salt of a dithiocarboxylic acid such as a silver salt of a dithioacetic acid, and a silver salt of a thioamide.

Suitable organic silver salts including silver salts of organic compounds having a carboxylic acid group can also be used. Examples thereof include a silver salt of an aliphatic carboxylic acid (for example, having 10 to 30 carbon atoms in the fatty acid) or a silver salt of an aromatic carboxylic acid. Preferred examples of the silver salts of aliphatic carboxylic acids include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof. When silver carboxylates are used, silver behenate is used alone or in mixtures with other silver salts.

In some embodiments of this invention, a mixture of a silver carboxylate and a silver salt of a compound having an imino group can be used.

Representative examples of the silver salts of aromatic carboxylic acids and other carboxylic acid group-containing compounds include, but are not limited to, silver benzoate, and silver substituted-benzoates, (such as silver 3,5-dihydroxy-benzoate, silver o-methylbenzoate, silver m-methylbenzoate, silver p-methylbenzoate, silver 2,4-dichlorobenzoate, silver acetamidobenzoate, silver p-phenylbenzoate, silver tannate, silver phthalate, silver terephthalate, silver salicylate, silver phenylacetate, and silver pyromellitate).

Silver salts of aliphatic carboxylic acids containing a thioether group as described in U.S. Pat. No. 3,330,663 (Weyde et al.) are also useful. Soluble silver carboxylates comprising hydrocarbon chains incorporating ether or thioether linkages, or sterically hindered substitution in the α-(on a hydrocarbon group) or ortho-(on an aromatic group) position, and displaying increased solubility in coating solvents and affording coatings with less light scattering can also be used. Such silver carboxylates are described in U.S. Pat. No. 5,491,059 (Whitcomb). Mixtures of any of the silver salts described herein can also be used if desired.

Silver salts of sulfonates are also useful in the practice of this invention. Such materials are described for example in U.S. Pat. No. 4,504,575 (Lee). Silver salts of sulfosuccinates are also useful as described for example in EP 0 227 141 A1 (Leenders et al.).

Moreover, silver salts of acetylenes can also be used as described, for example in U.S. Pat. No. 4,761,361 (Ozaki et al.) and U.S. Pat. No. 4,775,613 (Hirai et al.).

The methods used for making silver soap emulsions are well known in the art and are disclosed in *Research Disclosure*, April 1983, Item 22812, *Research Disclosure*, October 1983, Item 23419, U.S. Pat. No. 3,985,565 (Gabrielsen et al.) and the references cited above.

Non-photosensitive sources of reducible silver ions can also be provided as core-shell silver salts such as those described in commonly assigned and copending U.S. Pat. No. 6,355,408 (Whitcomb et al.), that is incorporated herein by reference. These silver salts include a core comprised of one or more silver salts and a shell having one or more different silver salts.

Still another useful source of non-photosensitive reducible silver ions in the practice of this invention are the silver dimer compounds that comprise two different silver salts as described in U.S. Pat. No. 6,472,131 (Whitcomb), that is incorporated herein by reference. Such non-photosensitive silver dimer compounds comprise two different silver salts, provided that when the two different silver salts comprise straight-chain, saturated hydrocarbon groups as the silver coordinating ligands, those ligands differ by at least 6 carbon atoms.

As one skilled in the art would understand, the non-photosensitive source of reducible silver ions can include various mixtures of the various silver salt compounds described herein, in any desirable proportions.

The photosensitive silver halide and the non-photosensitive source of reducible silver ions must be in catalytic proximity (that is, reactive association). It is preferred that these reactive components be present in the same emulsion layer.

The one or more non-photosensitive sources of reducible silver ions are preferably present in an amount of about 5% by weight to about 70% by weight, and more preferably, about 10% to about 50% by weight, based on the total dry weight of the emulsion layers. Stated another way, the amount of the sources of reducible silver ions is generally present in an amount of from about 0.001 to about 0.2 mol/m$^2$ of the dry photothermographic material, and preferably from about 0.01 to about 0.05 mol/m$^2$ of that material.

The total amount of silver (from all silver sources) in the photothermographic materials is generally at least 0.002 mol/m$^2$ and preferably from about 0.01 to about 0.05 mol/m$^2$.

Reducing Agents

The reducing agent (or reducing agent composition comprising two or more components) for the source of reducible silver ions can be any material, preferably an organic material, that can reduce silver (I) ion to metallic silver. Conventional photographic developing agents such as methyl gallate, hydro-quinone, substituted hydroquinones, 3-pyrazolidinones, p-aminophenols, p-phenylenediamines, hindered phenols, amidoximes, azines, catechol, pyrogallol, ascorbic acid (or derivatives thereof), leuco dyes and other materials readily apparent to one skilled in the art can be used in this manner as described for example in U.S. Pat. No. 6,020,117 (Bauer et al.).

An "ascorbic acid reducing agent" (also referred to as a developer or developing agent) means ascorbic acid, and complexes and derivatives thereof. Ascorbic acid developing agents are described in a considerable number of publications in photographic processes, including U.S. Pat. No. 5,236,816 (Purol et al.) and references cited therein. Useful ascorbic acid developing agents include ascorbic acid and the analogues, isomers and derivatives thereof. Such compounds include, but are not limited to, D- or L-ascorbic acid, sugar-type derivatives thereof (such as sorboascorbic acid, γ-lactoascorbic acid, 6-desoxy-L-ascorbic acid, L-rhamnoascorbic acid, imino-6-desoxy-L-ascorbic acid, glucoascorbic acid, fucoascorbic acid, glucoheptoascorbic acid, maltoascorbic acid, L-arabosascorbic acid), sodium ascorbate, potassium ascorbate, isoascorbic acid (or L-erythroascorbic acid), and salts thereof (such as alkali metal, ammonium or others known in the art), endiol type ascorbic acid, an enaminol type ascorbic acid, a thioenol type ascorbic acid, and an enamin-thiol type ascorbic acid, as described for example in U.S. Pat. No. 5,498,511 (Yamashita et al.), EP 0 585 792A1 (Passarella et al.), EP 0 573 700A1 (Lingier et al.), EP 0 588 408A1 (Hieronymus et al.), U.S. Pat. No. 5,089,819 (Knapp), U.S. Pat. No. 5,278,035 (Knapp), U.S. Pat. No. 5,384,232 (Bishop et al.), U.S. Pat. No. 5,376,510 (Parker et al.), JP Kokai 07-56286 (Toyoda), U.S. Pat. No. 2,688,549 (James et al.), and *Research Disclosure*, March 1995, Item 37152. D-, L-, or D,L-ascorbic acid (and alkali metal salts thereof) or isoascorbic acid (or alkali metal salts thereof) are preferred. Sodium ascorbate and sodium isoascorbate are preferred salts. Mixtures of these developing agents can be used if desired.

Particularly useful reducing agents are ascorbic acid mono- or di-fatty acid esters such as the monolaurate, monomyristate, monopalmitate, monostearate, monobehenate, diluarate, distearate, dipalmitate, dibehenate, and dimyristate derivatives of ascorbic acid as described in U.S. Pat. No. 3,832,186 (Masuda et al.) and U.S. Pat. No. 6,309,814 (Ito). Preferred ascorbic acid reducing agents and their methods of preparation are those described in U.S. Ser. No. 10/764,704 (filed on Jan. 26, 2004 by Ramsden et al.), now U.S. Publication 2005/0164136 and those described in U.S. Ser. No. 10/935,645 (filed on Sep. 7, 2004 by Brick, Ramsden, and Lynch), now U.S. Publication 2006/0051714, both of which are incorporated herein by reference. A preferred reducing agent is L-ascorbic acid 6-O-palmitate.

Hindered phenol reducing agents can also be used (alone or in combination with one or more high-contrast co-developing agents and co-developer contrast enhancing agents). Hindered phenols are compounds that contain only one hydroxy group on a given phenyl ring and have at least one additional substituent located ortho to the hydroxy group. Hindered phenol developers may contain more than one hydroxy group as long as each hydroxy group is located on different phenyl rings. Hindered phenol developers include, for example, binaphthols (that is, dihydroxybinaphthyls), biphenols (that is, dihydroxybiphenyls), bis(hydroxynaphthyl)methanes, bis(hydroxyphenyl)methanes (that is, bisphenols), hindered phenols, and hindered naphthols, each of which may be variously substituted.

Representative binaphthols include, but are not limited, to 1,1'-bi-2-naphthol, 1,1'-bi-4-methyl-2-naphthol and 6,6'-dibromo-bi-2-naphthol. For additional compounds see U.S. Pat. No. 3,094,417 (Workman) and U.S. Pat. No. 5,262,295 (Tanaka et al.), both incorporated herein by reference.

Representative biphenols include, but are not limited, to 2,2'-dihydroxy-3,3'-di-t-butyl-5,5-dimethylbiphenyl, 2,2'-dihydroxy-3,3',5,5'-tetra-t-butylbiphenyl, 2,2'-dihydroxy-3,3'-di-t-butyl-5,5'-dichloro-biphenyl, 2-(2-hydroxy-3-t-butyl-5-methylphenyl)-4-methyl-6-n-hexylphenol, 4,4'-dihydroxy-3,3',5,5'-tetra-t-butylbiphenyl and 4,4'-dihydroxy-3,3',5,5'-tetramethylbiphenyl. For additional compounds see U.S. Pat. No. 5,262,295 (noted above).

Representative bis(hydroxynaphthyl)methanes include, but are not limited to, 4,4'-methylenebis(2-methyl-1-naphthol). For additional compounds see U.S. Pat. No. 5,262,295 (noted above).

Representative bis(hydroxyphenyl)methanes include, but are not limited to, bis(2-hydroxy-3-t-butyl-5-methylphenyl) methane (CAO-5), 1,1'-bis(2-hydroxy-3,5-dimethylphenyl)-3,5,5-trimethylhexane (NONOX or PERMANAX WSO), 1,1'-bis(3,5-di-t-butyl-4-hydroxyphenyl)methane, 2,2'-bis(4-hydroxy-3-methylphenyl)propane, 4,4'-ethylidene-bis(2-t-butyl-6-methylphenol), 2,2'-isobutylidene-bis(4,6-dimethylphenol) (LOWINOX 221 B46), and 2,2'-bis(3,5-dimethyl-4-hydroxyphenyl)propane. For additional compounds see U.S. Pat. No. 5,262,295 (noted above).

Representative hindered phenols include, but are not limited to, 2,6-di-t-butylphenol, 2,6-di-t-butyl-4-methylphenol, 2,4-di-t-butylphenol, 2,6-dichlorophenol, 2,6-dimethylphenol and 2-t-butyl-6-methylphenol.

Representative hindered naphthols include, but are not limited to, 1-naphthol, 4-methyl-1-naphthol, 4-methoxy-1-naphthol, 4-chloro-1-naphthol and 2-methyl-1-naphthol. For additional compounds see U.S. Pat. No. 5,262,295 (noted above).

More specific alternative reducing agents that have been disclosed in dry silver systems including amidoximes such as phenylamidoxime, 2-thienylamidoxime and p-phenoxyphenylamidoxime, azines (for example, 4-hydroxy-3,5-dimethoxybenzaldehydrazine), a combination of aliphatic carboxylic acid aryl hydrazides and ascorbic acid [such as 2,2'-bis(hydroxymethyl)-propionyl-β-phenyl hydrazide in combination with ascorbic acid], a combination of polyhydroxybenzene and hydroxylamine, a reductone and/or a hydrazine [for example, a combination of hydroquinone and bis(ethoxyethyl)hydroxylamine], piperidino-hexose reductone or formyl-4-methylphenylhydrazine, hydroxamic acids (such as phenylhydroxamic acid, p-hydroxyphenylhydroxamic acid, and o-alanine-hydroxamic acid), a combination of azines and sulfonamidophenols (for example, phenothiazine and 2,6-dichloro-4-benzenesulfonamidophenol), α-cyanophenyl-acetic acid derivatives (such as ethyl α-cyano-2-methylphenylacetate and ethyl α-cyanophenylacetate), bis-o-naphthols [such as 2,2'-dihydroxyl-1-binaphthyl, 6,6'-dibromo-2,2'-dihydroxy-1,1'-binaphthyl, and bis (2-hydroxy-1-naphthyl)methane], a combination of bis-o-naphthol and a 1,3-dihydroxybenzene derivative (for example, 2,4-dihydroxybenzophenone or 2,4-dihydroxyacetophenone), 5-pyrazolones such as 3-methyl-1-phenyl-5-pyrazolone, reductones (such as dimethylaminohexose reductone, anhydrodihydro-aminohexose reductone and anhydrodihydro-piperidone-hexose reductone), sulfonamidophenol reducing agents (such as 2,6-dichloro-4-benzenesulfonamido-phenol, and p-benzenesulfonamidophenol), indane-1,3-diones (such as 2-phenylindane-1,3-dione), chromans (such as 2,2-dimethyl-7-t-butyl-6-hydroxychroman), 1,4-dihydropyridines (such as 2,6-dimethoxy-3,5-dicarbethoxy-1,4-dihydropyridine), ascorbic acid derivatives (such as 1-ascorbylpalmitate, ascorbylstearate), and unsaturated aldehydes, ketones, and 3-pyrazolidones.

An additional class of reducing agents that can be used as developers are substituted hydrazines including the sulfonyl hydrazides described in U.S. Pat. No. 5,464,738 (Lynch et al.). Still other useful reducing agents are described, for example, in U.S. Pat. No. 3,074,809 (Owen), U.S. Pat. No. 3,094,417 (Workman), U.S. Pat. No. 3,080,254 (Grant, Jr.) and U.S. Pat. No. 3,887,417 (Klein et al.). Auxiliary reducing agents may be useful as described in U.S. Pat. No. 5,981,151 (Leenders et al.). All of these patents are incorporated herein by reference.

In some instances, the reducing agent composition comprises two or more components such as a hindered phenol developer and a co-developer that can be chosen from the various classes of reducing agents described below. Ternary developer mixtures involving the further addition of contrast enhancing agents are also useful. Such contrast enhancing agents can be chosen from the various classes of reducing agents described below.

Additional classes of reducing agents that can be used as co-developers are trityl hydrazides and formyl phenyl hydrazides as described in U.S. Pat. No. 5,496,695 (Simpson et al.), incorporated herein by reference.

Various contrast enhancing agents can be used in some photothermographic materials with specific co-developers. Examples of useful contrast enhancers include, but are not limited to, hydroxylamines (including hydroxyl-amine and alkyl- and aryl-substituted derivatives thereof), alkanolamines and ammonium phthalamate compounds as described for example, in U.S. Pat. No. 5,545,505 (Simpson), hydroxamic acid compounds as described for example, in U.S. Pat. No. 5,545,507 (Simpson et al.), N-acylhydrazine compounds as described for example, in U.S. Pat. No. 5,558,983 (Simpson et al.), and hydrogen atom donor compounds as described in U.S. Pat. No. 5,637,449 (Harring et al.). All of the patents above are incorporated herein by reference.

It is to be understood that not all combinations of developer and non-photosensitive source of reducible silver ions work equally well. One preferred combination includes a silver salt of benzotriazole, substituted derivatives thereof, or mixtures of such silver salts as the non-photosensitive source of reducible silver ions and an ascorbic acid reducing agent.

Another combination includes a silver fatty acid carboxylate having 10 to 30 carbon atoms, or mixtures of said silver carboxylates as the non-photosensitive source of reducible silver ions and a hindered phenol as the reducing agent.

The reducing agent (or mixture thereof) described herein is generally present as 1 to 10% (dry weight) of the emulsion layer. In multilayer constructions, if the reducing agent is added to a layer other than an emulsion layer, slightly higher proportions, of from about 2 to 15 weight % may be more desirable. Any co-developers may be present generally in an amount of from about 0.001% to about 1.5% (dry weight) of the emulsion layer coating.

Other Addenda

The photothermographic materials of the invention can also contain other additives such as shelf-life stabilizers, antifoggants, contrast enhancing agents, toners, development accelerators, acutance dyes, post-processing stabilizers or stabilizer precursors, toners, thermal solvents (also known as "melt formers"), and other image-modifying agents as would be readily apparent to one skilled in the art.

To further control the properties of photothermographic materials, (for example, contrast, $D_{min}$, speed, or fog), it may be preferable to add one or more heteroaromatic mercapto compounds or heteroaromatic disulfide compounds of the formulae Ar—S-$M^1$ and Ar—S—S—Ar, wherein $M^1$ represents a hydrogen atom or an alkali metal atom and Ar represents a heteroaromatic ring or fused heteroaromatic ring containing one or more of nitrogen, sulfur, oxygen, selenium, or tellurium atoms. Preferably, the heteroaromatic ring comprises benzimidazole, naphthimidazole, benzothiazole, naphthothiazole, benzoxazole, naphthoxazole, benzoselenazole, benzotellurazole, imidazole, oxazole, pyrazole, triazole, thiazole, thiadiazole, tetrazole, triazine, pyrimidine, pyridazine, pyrazine, pyridine, purine, quinoline, or quinazolinone. Compounds having other heteroaromatic rings and compounds providing enhanced sensitization at other wavelengths are also envisioned to be suitable. For example, heteroaromatic mercapto compounds are described as supersensitizers for infrared photothermographic materials in EP 0 559 228A1 (Philip Jr. et al.).

The photothermographic materials of the present invention can be further protected against the production of fog and can be stabilized against loss of sensitivity during storage. While not necessary for the practice of the invention, it may be advantageous to add mercury (II) salts to the emulsion layer(s) as an antifoggant. Preferred mercury (II) salts for this purpose are mercuric acetate and mercuric bromide. Other useful mercury salts include those described in U.S. Pat. No. 2,728,663 (Allen).

Other suitable antifoggants and stabilizers that can be used alone or in combination include thiazolium salts as described in U.S. Pat. No. 2,131,038 (Staud) and U.S. Pat. No. 2,694,716 (Allen), azaindenes as described in U.S. Pat. No. 2,886,437 (Piper), triazaindolizines as described in U.S. Pat. No. 2,444,605 (Heimbach), the urazoles described in U.S. Pat. No. 3,287,135 (Anderson), sulfocatechols as described in U.S. Pat. No. 3,235,652 (Kennard), the oximes described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum, and gold salts as described in U.S. Pat. No. 2,566,263 (Trirelli) and U.S. Pat. No. 2,597,915 (Damshroder), compounds having—$SO_2CBr_3$ groups as described for example in U.S. Pat. No. 5,594,143 (Kirk et al.) and U.S. Pat. No. 5,374,514 (Kirk et al.), and 2-(tribromomethylsulfonyl)quinoline compounds as described in U.S. Pat. No. 5,460,938 (Kirk et al.).

Stabilizer precursor compounds capable of releasing stabilizers upon application of heat during development can also be used. Such precursor compounds are described in for example, U.S. Pat. No. 5,158,866 (Simpson et al.), U.S. Pat.

No. 5,175,081 (Krepski et al.), U.S. Pat. No. 5,298,390 (Sakizadeh et al.), and U.S. Pat. No. 5,300,420 (Kenney et al.).

In addition, certain substituted-sulfonyl derivatives of benzotriazoles (for example alkylsulfonylbenzotriazoles and arylsulfonylbenzotriazoles) have been found to be useful stabilizing compounds (such as for post-processing print stabilizing), as described in U.S. Pat. No. 6,171,767 (Kong et al.).

Furthermore, other specific useful antifoggants/stabilizers are described in more detail in U.S. Pat. No. 6,083,681 (Lynch et al.), incorporated herein by reference.

The photothermographic materials may also include one or more polyhalo antifoggants that include one or more polyhalo substituents including but not limited to, dichloro, dibromo, trichloro, and tribromo groups. The antifoggants can be aliphatic, alicyclic, or aromatic compounds, including aromatic heterocyclic and carbocyclic compounds.

Particularly useful antifoggants of this type are polyhalo antifoggants, such as those having a $—SO_2C(X')_3$ group wherein X' represents the same or different halogen atoms.

Another class of useful antifoggants are those described in U.S. Pat. No. 6,514,678 (Burgmaier et al.), incorporated herein by reference.

Advantageously, the photothermographic materials of this invention also include one or more "thermal solvents" also called "heat solvents," thermosolvents," "melt formers," "waxes," or "plasticizers" for improving the reaction speed of the silver-developing redox-reaction at elevated temperature.

By the term "thermal solvent" in this invention is meant an organic material that becomes a plasticizer or liquid solvent in at least one of the imaging layers upon heating at a temperature above 60° C. Useful for that purpose are a polyethylene glycol having a mean molecular weight in the range of 1,500 to 20,000 described in U.S. Pat. No. 3,347,675. Further are mentioned compounds such as urea, methyl sulfonamide and ethylene carbonate being thermal solvents described in U.S. Pat. No. 3,667,959, and compounds such as tetrahydro-thiophene-1,1-dioxide, methyl anisate and 1,10-decanediol being described as thermal solvents in *Research Disclosure*, December 1976, Item 15027, pages 26–28. Other representative examples of such compounds include, but are not limited to, salicylanilide, phthalimide, N-hydroxyphthalimide, N-potassium-phthalimide, succinimide, N-hydroxy-1,8-naphthalimide, phthalazine, 1-(2H)-phthalazinone, nicotinamide, 2-acetylphthalazinone, benzanilide, dimethylurea, non-polymeric polyhydroxy compounds (such as D-sorbitol, pentaerythritol, meso-erythritol, and xylitol), and benzenesulfonamide. Combinations of these compounds can also be used including a combination of succinimide and dimethylurea. Still other examples of thermal solvents have been described in U.S. Pat. No. 3,438,776 (Yudelson), U.S. Pat. No. 4,473,631 (Hiroyuki et al.), U.S. Pat. No. 4,740,446 (Schranz et al.), U.S. Pat. No. 6,013,420 (Windender), U.S. Pat. No. 5,368,979 (Freedman et al.), U.S. Pat. No. 5,716,772 (Taguchi et al.), and U.S. Pat. No. 5,250,386 (Aono et al.), and in published EP 0 119 615A1 (Nakamura et al.) and EP 0 122 512A1 (Aono et al.), all incorporated herein by reference.

Toners

"Toners" are compounds that improve image color and increase the optical density of the developed image. For black and white photothermographic films, particularly useful toners are those that also contribute to the formation of a black image upon development. Thus, the use of "toners" or derivatives thereof is highly desirable and toners are preferably included in the photothermographic materials described herein. Such compounds are well known materials in the photothermographic art, as described in U.S. Pat. No. 3,080,254 (Grant, Jr.), U.S. Pat. No. 3,847,612 (Winslow), U.S. Pat. No. 4,123,282 (Winslow), U.S. Pat. No. 4,082,901 (Laridon et al.), U.S. Pat. No. 3,074,809 (Owen), U.S. Pat. No. 3,446,648 (Workman), U.S. Pat. No. 3,844,797 (Willems et al.), U.S. Pat. No. 3,951,660 (Hagemann et al.), U.S. Pat. No. 5,599,647 (Defieuw et al.), U.S. Pat. No. 4,220,709 (deMauriac et al.), U.S. Pat. No. 4,451,561 (Hirabayashi et al.), U.S. Pat. No. 4,543,309 (Hirabayashi et al.), U.S. Pat. No. 3,832,186 (Masuda et al.), U.S. Pat. No. 4,201,582 (White et al.), U.S. Pat. No. 3,881,938 (Masuda et al.), and GB 1,439,478 (AGFA).

Examples of toners include, but are not limited to, phthalimide and N-hydroxyphthalimide, cyclic imides (such as succinimide), pyrazoline-5-ones, quinazolinone, 1-phenylurazole, 3-phenyl-2-pyrazoline-5-one, and 2,4-thiazolidinedione, naphthalimides (such as N-hydroxy-1,8-naphthalimide), cobalt complexes [such as hexaaminecobalt(3+) trifluoroacetate], mercaptans (such as mercaptotriazoles including 3-mercapto-1,2,4-triazole, 3-mercapto-4-phenyl-1,2,4-triazole, 4-phenyl-1,2,4-triazolidine-3,5-dithione, 4-allyl-3-amino-5-mercapto-1,2,4-triazole and 4-methyl-5-thioxo-1,2,4-triazolidin-3-one, pyrimidines including 2,4-dimercaptopyrimidine, thiadiazoles including 2,5-dimercapto-1,3,4-thiadiazole, 5-methyl-1,3,4-thiadiazolyl-2-thiol, mercaptotetrazoles including 1-phenyl-5-mercaptotetrazole, and 5-acetylamino-1,3,4-thiadiazoline-2-thione, mercaptoimidazoles including 1,3-dihydro-1-phenyl-2H-Imidazole-2-thione,), N-(aminomethyl)aryldicarboximides [such as (N,N-dimethylaminomethyl)phthalimide, and N-(dimethylaminomethyl)naphthalene-2,3-dicarboximide], a combination of blocked pyrazoles, isothiuronium derivatives, and certain photobleach agents [such as a combination of N,N'-hexamethylene-bis(1-carbamoyl-3,5-dimethylpyrazole), 1,8-(3,6-diaza-octane)bis(isothiuronium)trifluoroacetate, and 2-(tribromomethylsulfonyl benzothiazole)], merocyanine dyes {such as 3-ethyl-5-[(3-ethyl-2-benzothiazolinylidene)-1-methyl-ethylidene]-2-thio-2,4-oazolidinedione}, phthalazine and derivatives thereof [such as those described in U.S. Pat. No. 6,146,822 (Asanuma et al.)], phthalazinone and phthalazinone derivatives, or metal salts or these derivatives [such as 4-(1-naphthyl)phthalazinone, 6-chlorophthalazinone, 5,7-dimethoxyphthalazinone, and 2,3-dihydro-1,4-phthalazinedione], a combination of phthalazine (or derivative thereof) plus one or more phthalic acid derivatives (such as phthalic acid, 4-methylphthalic acid, 4-nitrophthalic acid, and tetrachlorophthalic anhydride), quinazolinediones, benzoxazine or naphthoxazine derivatives, rhodium complexes functioning not only as tone modifiers but also as sources of halide ion for silver halide formation in-situ [such as ammonium hexa-chlororhodate (III), rhodium bromide, rhodium nitrate, and potassium hexachloro-thodate (III)], benzoxazine-2,4-diones (such as 1,3-benzoxazine-2,4-dione, 8-methyl-1,3-benzoxazine-2,4-dione and 6-nitro-1,3-benzoxazine-2,4-dione), pyrimidines and asym-triazines (such as 2,4-dihydroxypyrimidine, 2-hydroxy-4-aminopyrimidine and azauracil) and tetraazapentalene derivatives [such as 3,6-dimercapto-1,4-diphenyl-1H, 4H-2,3a,5,6a-tetraazapentalene and 1,4-di-(o-chlorophenyl)-3,6-dimercapto-1H, 4H-2,3 a,5,6a-tetraazapentalene].

Phthalazine and phthalazine derivatives [such as those described in U.S. Pat. No. 6,146,822 (noted above), incorporated herein by reference] are particularly useful as toners in when using silver carboxylate compounds as the non-photosensitive source of reducible silver and hindered phenols as developers. Phthalazine and derivatives thereof can be used in any layer of the photothermographic material on either side of the support.

Compounds that are particularly useful as toners in the practice of this invention are defined by Structure II below. These toners provide the best images with sufficient density so the speed of the photothermographic materials can be readily measured according to the present invention. These toners are particularly useful when silver salts of nitrogen-containing heterocyclic compounds containing an imino group are used as the non-photosensitive sources of reducible silver and ascorbic acid, and an ascorbic acid complex or an ascorbic acid derivative (such as an ester) is used as a reducing agent. The compounds of Structure II are mercaptotriazole compounds defined as follows:

(II)

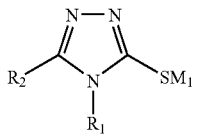

wherein $R_1$ and $R_2$ independently represent hydrogen, a substituted or unsubstituted alkyl group of from 1 to 7 carbon atoms (such as methyl, ethyl, isopropyl, t-butyl, n-hexyl, hydroxymethyl, and benzyl), a substituted or unsubstituted alkenyl group having 2 to 5 carbon atoms in the hydrocarbon chain (such as ethenyl, 1,2-propenyl, methallyl, and 3-buten-1-yl), a substituted or unsubstituted cycloalkyl group having 5 to 7 carbon atoms forming the ring (such as cyclopenyl, cyclohexyl, and 2,3-dimethylcyclohexyl), a substituted or unsubstituted aromatic or non-aromatic heterocyclyl group having 5 or 6 carbon, nitrogen, oxygen, or sulfur atoms forming the aromatic or non-aromatic heterocyclyl group (such as pyridyl, furanyl, thiazolyl, and thienyl), an amino or amide group (such as amino or acetamido), and a substituted or unsubstituted aryl group having 6 to 10 carbon atoms forming the aromatic ring (such as phenyl, tolyl, naphthyl, and 4-ethoxyphenyl).

In addition, $R_1$ and $R_2$ can be a substituted or unsubstituted $Y_1$—$(CH_2)_k$— group wherein $Y_1$ is a substituted or unsubstituted aryl group having 6 to 10 carbon atoms as defined above for $R_1$ and $R_2$, or a substituted or unsubstituted aromatic or non-aromatic heterocyclyl group as defined above for $R_1$. Also, k is 1–3.

Alternatively, $R_1$ and $R_2$ taken together can form a substituted or unsubstituted, saturated or unsaturated 5- to 7-membered aromatic or non-aromatic nitrogen-containing heterocyclic ring comprising carbon, nitrogen, oxygen, or sulfur atoms in the ring (such as pyridyl, diazinyl, triazinyl, piperidine, morpholine, pyrrolidine, pyrazolidine, and thiomorpholine).

Still again, $R_1$ or $R_2$ can represent a divalent linking group (such as a phenylene, methylene, or ethylene group) linking two mercaptotriazole groups, and $R_2$ may further represent carboxy or its salts.

$M_1$ is hydrogen or a monovalent cation (such as an alkali metal cation, an ammonium ion, or a pyridinium ion).

The definition of mercaptotriazoles of Structure II also includes the following provisos:

1) $R_1$ and $R_2$ are not simultaneously hydrogen.

2) When $R_1$ is substituted or unsubstituted phenyl or benzyl, $R_2$ is not substituted or unsubstituted phenyl or benzyl.

3) When $R_2$ is hydrogen, $R_1$ is not allenyl, 2,2-diphenylethyl, α-methylbenzyl, or a phenyl group having a cyano or a sulfonic acid substituent.

4) When $R_1$ is benzyl or phenyl, $R_2$ is not substituted 1,2-dihydroxyethyl, or 2-hydroxy-2-propyl.

5) When $R_1$ is hydrogen, $R_2$ is not 3-phenylthiopropyl.

In one further optional embodiment, the photothermographic material is further defined wherein:

6) One or more thermally developable imaging layers has a pH less than 7.

Preferably, $R_1$ is methyl, t-butyl, a substituted phenyl or benzyl group. More preferably $R_1$ is benzyl. Also, $R_1$ can represent a divalent linking group (such as a phenylene, methylene, or ethylene group) that links two mercaptotriazole groups.

Preferably, $R_2$ is hydrogen, acetamido, or hydroxymethyl. More preferably, $R_2$ is hydrogen. Also, $R_2$ can represent a divalent linking group (such as a phenylene, methylene, or ethylene group) that links two mercaptotriazole groups.

As noted above, in one embodiment, one or more thermally developable imaging layers has a pH less than 7. The pH of these layers may be conveniently controlled to be acidic by addition of ascorbic acid as the developer. Alternatively, the pH may be controlled by adjusting the pH of the silver salt dispersion prior to coating with mineral acids such as, for example, sulfuric acid or nitric acid or by addition of organic acids such as citric acid. It is preferred that the pH of the one or more imaging layers be less than 7 and preferably less than 6. This pH value can be determined using a surface pH electrode after placing a drop of $KNO_3$ solution on the sample surface. Such electrodes are available from Corning Inc. (Corning, N.Y.).

Many of the toners described herein are heterocyclic compounds. It is well known that heterocyclic compounds exist in tautomeric forms. In addition both annular (ring) tautomerism and substituent tautomerism are often possible.

For example, in one preferred class of toners, 1,2,4-mercapto-triazole compounds, at least three tautomers (a 1H form, a 2H form, and a 4H form) are possible.

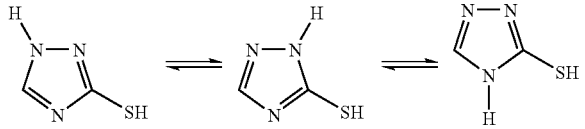

1H-form 2H-form 4H-form

In addition, 1,2,4-mercaptotriazoles are also capable of thiol-thione substituent tautomerism.

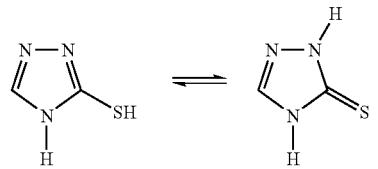

Thiol form Thione form

Interconversion among these tautomers can occur rapidly and individual tautomers cannot be isolated, although one tautomeric form may predominate. For the 1,2,4-mercaptotriazoles described herein, the 4H-thiol structural formalism is used with the understanding that such tautomers do exist.

Mercaptotriazole compounds represented by Structure II are particularly preferred when used with silver benzotriazole as the non-photosensitive source of reducible silver and ascorbic acid as the reducing agent. When so used, compounds represented by Structure II have been found to give dense black images.

The mercaptotriazole toners described herein can be readily prepared using well known synthetic methods. For example, compound T-1 can be prepared as described in U.S. Pat. No. 4,628,059 (Finkelstein et al.). Additional preparations of various mercaptotraizoles are described in U.S. Pat. No. 3,769,411 (Greenfield et al.), U.S. Pat. No. 4,183,925 (Baxter et al.), U.S. Pat. No. 6,074,813 (Asanuma et al.), DE 1 670 604 (Korosi), and in *Chem. Abstr.* 1968, 69, 52114j. Some mercaptotriazole compounds are commercially available.

As would be understood by one skilled in the art, two or more mercaptotriazole toners as defined by Structure II can be used in the practice of this invention if desired, and the multiple toners can be located in the same or different layers of the photothermographic materials.

Additional conventional toners can also be included with the one or more mercaptotriazoles described above. Such compounds are well known materials in the photothermographic art, as shown in U.S. Pat. No. 3,080,254 (Grant, Jr.), U.S. Pat. No. 3,847,612 (Winslow), U.S. Pat. No. 4,123,282 (Winslow), U.S. Pat. No. 4,082,901 (Laridon et al.), U.S. Pat. No. 3,074,809 (Owen), U.S. Pat. No. 3,446,648 (Workman), U.S. Pat. No. 3,844,797 (Willems et al.), U.S. Pat. No. 3,951,660 (Hagemann et al.), U.S. Pat. No. 5,599,647 (Defieuw et al.) and GB 1,439,478 (AGFA).

Mixtures of mercaptotriazoles with additional toners are also useful in the practice of this invention. For example, 3-mercapto-4-benzyl-1,2,4-triazole may be mixed with phthalazine, the phthalazine compounds described in U.S. Pat. No. 6,605,418 (Ramsden et al.), the triazine thione compounds described in U.S. Pat. No. 6,703,191 (Lynch et al.), or the heterocyclic disulfide compounds described in U.S. Pat. No. 6,737,227 (Lynch et al.). All of these patents are incorporated herein by reference.

Generally, one or more toners described herein are present in an amount of about 0.01% by weight to about 10%, and more preferably about 0.1% by weight to about 10% by weight, based on the total dry weight of the layer in which it is included. Toners may be incorporated in one or more of the thermally developable imaging layers as well as in adjacent layers such as a protective overcoat or underlying "carrier" layer. The toners can be located on both sides of the support if thermally developable imaging layers are present on both sides of the support.

Binders

The tabular grain photosensitive silver halide, the non-photosensitive source of reducible silver ions, the reducing agent composition, toner(s), and any other additives used in the present invention are generally added to one or more hydrophilic binders or water-dispersible latex polymer binders. Thus, predominantly aqueous formulations (at least 50 solvent volume % and preferably at least 70 solvent volume % is water) are used to prepare the photothermographic materials of this invention. Mixtures of such binders can also be used.

Examples of useful hydrophilic binders include, but are not limited to, proteins and protein derivatives, gelatin and gelatin derivatives (hardened or unhardened, including alkali- and acid-treated gelatins, acetylated gelatin, oxidized gelatin, phthalated gelatin, and deionized gelatin), cellulosic materials such as hydroxymethyl cellulose and cellulosic esters, acrylamide/methacrylamide polymers, acrylic/methacrylic polymers polyvinyl pyrrolidones, polyvinyl alcohols, poly(vinyl lactams), polymers of sulfoalkyl acrylate or methacrylates, hydrolyzed polyvinyl acetates, polyacrylamides, polysaccharides (such as dextrans and starch ethers), and other synthetic or naturally occurring vehicles commonly known for use in aqueous-based photographic emulsions (see for example, *Research Disclosure*, Item 38957, noted above). Cationic starches can be also be used as a peptizer for tabular silver halide grains as described in U.S. Pat. No. 5,620,840 (Maskasky) and U.S. Pat. No. 5,667,955 (Maskasky).

Particularly useful hydrophilic binders are gelatin, gelatin derivatives, polyvinyl alcohols, and cellulosic materials. Gelatin and its derivatives are most preferred, and comprise at least 75 weight % of total binders when a mixture of binders is used. Water-dispersible latex polymer binders are described, for example, in EP 0 911 691 A1 (Ishizaka et al.)

"Minor" amounts of hydrophobic binders can also be present as long as more than 50% (by weight of total binders) is composed of hydrophilic binders. Examples of typical hydrophobic binders include, but are not limited to, polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers, and other materials readily apparent to one skilled in the art. Copolymers (including terpolymers) are also included in the definition of polymers. The polyvinyl acetals (such as polyvinyl butyral and polyvinyl formal) and vinyl copolymers (such as polyvinyl acetate and polyvinyl chloride) are particularly preferred. Particularly suitable binders are polyvinyl butyral resins that are available as BUTVAR® B79 (Solutia, Inc.) and PIOLOFORM® BS-18 or PIOLOFORM® BL-16 (Wacker Chemical Company).

Hardeners for various binders may be present if desired and the hydrophilic binders used in the photothermographic materials are generally partially or fully hardened using any conventional hardener. Useful hardeners are well known and include vinyl sulfone compounds described, U.S. Pat. No. 6,143,487 (Philip et al.), EP 0 460 589A1 (Gathmann et al.), aldehydes, and various other hardeners described in U.S. Pat. No. 6,190,822 (Dickerson et al.), as well as those described in T. H. James, *The Theory of the Photographic Process*, Fourth Edition, Eastman Kodak Company, Rochester, N.Y., 1977, Chapter 2, pp. 77–8.

Where the proportions and activities of the photothermographic materials require a particular developing time and temperature, the binder(s) should be able to withstand those conditions. Generally, it is preferred that the binder does not decompose or lose its structural integrity at 150° C. for 60 seconds. It is more preferred that the binder does not decompose or lose its structural integrity at 177° C. for 60 seconds.

The polymer binder(s) is used in an amount sufficient to carry the components dispersed therein. The effective range can be appropriately determined by one skilled in the art. Preferably, a binder is used at a level of about 10% by weight to about 90% by weight, and more preferably at a level of about 20% by weight to about 70% by weight, based on the total dry weight of the layer in which it is included. The amount of binders in double-sided photothermographic materials can be the same or different.

Support Materials

The photothermographic materials of this invention comprise a polymeric support that is preferably a flexible, transparent film that has any desired thickness and is composed of one or more polymeric materials, depending upon their use. The supports are generally transparent (especially if the material is used as a photomask) or at least translucent, but in some instances, opaque supports may be useful. They are required to exhibit dimensional stability during thermal development and to have suitable adhesive properties with overlying layers. Useful polymeric materials for making such supports include, but are not limited to, polyesters (such as polyethylene terephthalate and polyethylene naphthalate), cellulose acetate and other cellulose esters, polyvinyl acetal, polyolefins (such as polyethylene and polypropylene), polycarbonates, and polystyrenes (and polymers of styrene derivatives). Preferred supports are composed of polymers having good heat stability, such as polyesters and polycarbonates. Support materials may also be treated or annealed to reduce shrinkage and promote dimensional stability. Polyethylene terephthalate film is a particularly preferred support. Various support materials are described, for example, in *Research Disclosure*, August 1979, Item 18431. A method of making dimensionally stable polyester films is described in *Research Disclosure*, September 1999, Item 42536.

It is also useful to use supports comprising dichroic mirror layers wherein the dichroic mirror layer reflects radiation at least having the predetermined range of wavelengths to the emulsion layer and transmits radiation having wavelengths outside the predetermined range of wavelengths. Such dichroic supports are described in U.S. Pat. No. 5,795,708 (Boutet), incorporated herein by reference.

It is further possible to use transparent, multilayer, polymeric supports comprising numerous alternating layers of at least two different polymeric materials. Such multilayer polymeric supports preferably reflect at least 50% of actinic radiation in the range of wavelengths to which the photothermographic sensitive material is sensitive, and provide photothermographic materials having increased speed. Such transparent, multilayer, polymeric supports are described in U.S. Pat. No. 6,630,283 (Simpson et al.), incorporated herein by reference.

Opaque supports, such as dyed polymeric films and resin-coated papers that are stable to high temperatures, can also be used.

Support materials can contain various colorants, pigments, antihalation or acutance dyes if desired. For example, when the photothermographic material is used as a medical imaging film, a transparent, blue-tinted poly(ethylene terephthalate) film support containing one or more blue tinting dyes is often preferred, and when the photothermographic material is used as a photomask, a transparent clear support is often used.

Support materials may be treated using conventional procedures (such as corona discharge) to improve adhesion of overlying layers, or subbing or other adhesion-promoting layers can be used. Useful subbing layer formulations include those conventionally used for photographic materials such as vinylidene halide polymers.

Photothermographic Formulations

An aqueous formulation for the photothermographic emulsion layer(s) can be prepared by dissolving and dispersing the hydrophilic binder (such as gelatin or a gelatin derivative) or water-dispersible latex polymer, the photosensitive ultrathin tabular grain silver halide(s), the non-photosensitive source of reducible silver ions, the reducing agent composition, and optional addenda in water or water-organic solvent mixtures to provide aqueous-based coating formulations. Minor (less than 50 volume %) of water-miscible organic solvents such as water-miscible alcohols, acetone, or methyl ethyl ketone, may also be present. Preferably, the solvent system used to provide these formulations is at least 80 volume % water and more preferably the solvent system is at least 90 volume % water.

Photothermographic materials of this invention can contain plasticizers and lubricants such as polyalcohols and diols of the type described in U.S. Pat. No. 2,960,404 (Milton et al.), fatty acids or esters such as those described in U.S. Pat. No. 2,588,765 (Robijns) and U.S. Pat. No. 3,121,060 (Duane), and silicone resins such as those described in GB 955,061 (DuPont). The materials can also contain matting agents such as starch, titanium dioxide, zinc oxide, silica, and polymeric beads including beads of the type described in U.S. Pat. No. 2,992,101 (Jelley et al.) and U.S. Pat. No. 2,701,245 (Lynn). Polymeric fluorinated surfactants may also be useful in one or more layers of the photothermographic materials for various purposes, such as improving coatability and optical density uniformity as described in U.S. Pat. No. 5,468,603 (Kub).

EP 0 792 476 B1 (Geisler et al.) describes various means of modifying photothermographic materials to reduce what is known as the "woodgrain" effect, or uneven optical density. This effect can be reduced or eliminated by several means, including treatment of the support, adding matting agents to the topcoat, using acutance dyes in certain layers or other procedures described in the noted publication.

The photothermographic materials of this invention can include antistatic or conducting layers. Such layers may contain soluble salts (for example, chlorides or nitrates), evaporated metal layers, or ionic polymers such as those described in U.S. Pat. No. 2,861,056 (Minsk) and U.S. Pat. No. 3,206,312 (Sterman et al.), or insoluble inorganic salts such as those described in U.S. Pat. No. 3,428,451 (Trevoy), electroconductive underlayers such as those described in U.S. Pat. No. 5,310,640 (Markin et al.), electronically-conductive metal antimonate particles such as those described in U.S. Pat. No. 5,368,995 (Christian et al.), and electrically-conductive metal-containing particles dispersed in a polymeric binder such as those described in EP 0 678 776A1 (Melpolder et al.). Other antistatic agents are well known in the art.

Other conductive compositions include one or more fluoro-chemicals each of which is a reaction product of $R_f$—$CH_2CH_2$—$SO_3H$ with an amine wherein $R_f$ comprises 4 or more fully fluorinated carbon atoms. These antistatic compositions are described in more detail in U.S. Pat. No. 6,699,648 (Sakizadeh et al.) that is incorporated herein by reference.

Additional conductive compositions include one or more fluoro-chemicals having the structure $R_f$—R—$N(R'_1)(R'_2)(R'_3)^+ X^-$ wherein $R_f$ is a straight or branched chain perfluoroalkyl group having 4 to 18 carbon atoms, R is a divalent linking group comprising at least 4 carbon atoms and a sulfide group in the chain, $R'_1$, $R'_2$, $R'_3$ are independently hydrogen or alkyl groups or any two of $R'_1$, $R'_2$, and $R'_3$ taken together can represent the carbon and nitrogen atoms necessary to provide a 5- to 7-membered heterocyclic ring with the cationic nitrogen atom, and $X^-$ is a monovalent anion. These antistatic compositions are described in more detail in U.S. Pat. No. 6,762,013 (Sakizadeh et al.) that is incorporated herein by reference.

The photothermographic materials of this invention can be constructed of one or more layers on a support. Single layer materials should contain the tabular grain photosensitive silver halide, the non-photosensitive source of reducible silver ions, the reducing agent composition, the hydrophilic binder, as well as optional materials such as toners, acutance dyes, coating aids and other adjuvants.

Two-layer constructions comprising a single imaging layer coating containing all the ingredients and a surface protective topcoat are generally found in the materials of this invention. However, two-layer constructions containing photosensitive silver halide and non-photosensitive source of reducible silver ions in one imaging layer (usually the layer adjacent to the support) and the reducing agent composition and other ingredients in the second imaging layer or distributed between both layers are also envisioned.

For double-sided photothermographic materials, both sides of the support can include one or more of the same or different imaging layers, interlayers, and protective topcoat layers. In such materials preferably a topcoat is present as the outermost layer on both sides of the support. The thermally developable layers on opposite sides can have the same or different construction and can be overcoated with the same or different protective layers.

Layers to promote adhesion of one layer to another in photothermographic materials are also known, as described for example in U.S. Pat. No. 5,891,610 (Bauer et al.), U.S. Pat. No. 5,804,365 (Bauer et al.), and U.S. Pat. No. 4,741,992 (Przezdziecki). Adhesion can also be promoted using specific polymeric adhesive materials as described for example in U.S. Pat. No. 5,928,857 (Geisler et al.).

Layers to reduce emissions from the film may also be present, including the polymeric barrier layers described in U.S. Pat. No. 6,352,819 (Kenney et al.), U.S. Pat. No. 6,352,820 (Bauer et al.), U.S. Pat. No. 6,420,102 (Bauer et al.), U.S. Pat. No. 6,667,148 (Rao et al.) and U.S. Pat. No. 6,746,831 (Hunt), all incorporated herein by reference.

Photothermographic formulations described herein can be coated by various coating procedures including wire wound rod coating, dip coating, air knife coating, curtain coating, slide coating, or extrusion coating using hoppers of the type described in U.S. Pat. No. 2,681,294 (Beguin). Layers can be coated one at a time, or two or more layers can be coated simultaneously by the procedures described in U.S. Pat. No. 2,761,791 (Russell), U.S. Pat. No. 4,001,024 (Dittman et al.), U.S. Pat. No. 4,569,863 (Keopke et al.), U.S. Pat. No. 5,340,613 (Hanzalik et al.), U.S. Pat. No. 5,405,740 (LaBelle), U.S. Pat. No. 5,415,993 (Hanzalik et al.), U.S. Pat. No. 5,525,376 (Leonard), U.S. Pat. No. 5,733,608 (Kessel et al.), U.S. Pat. No. 5,849,363 (Yapel et al.), U.S. Pat. No. 5,843,530 (Jerry et al.), U.S. Pat. No. 5,861,195 (Bhave et al.), and GB 837,095 (Ilford). A typical coating gap for the emulsion layer can be from about 10 to about 750 μm, and the layer can be dried in forced air at a temperature of from about 20° C. to about 100° C. It is preferred that the thickness of the layer be selected to provide maximum image densities greater than about 0.2, and more preferably, from about 0.5 to 5.0 or more, as measured by a MacBeth Color Densitometer Model TD 504.

When the layers are coated simultaneously using various coating techniques, a "carrier" layer formulation comprising a single-phase mixture of the two or more polymers described above may be used. Such formulations are described U.S. Pat. No. 6,355,405 (Ludemann et al.), incorporated herein by reference.

Mottle and other surface anomalies can be reduced in the materials of this invention by incorporation of a fluorinated polymer as described for example in U.S. Pat. No. 5,532,121 (Yonkoski et al.) or by using particular drying techniques as described, for example in U.S. Pat. No. 5,621,983 (Ludemann et al.).

Preferably, two or more layers are applied to a film support using slide coating. The first layer can be coated on top of the second layer while the second layer is still wet. The first and second fluids used to coat these layers can be the same or different.

While the first and second layers can be coated on one side of the film support, manufacturing methods can also include forming on the opposing or backside of said polymeric support, one or more additional layers, including an antihalation layer, an antistatic layer, or a layer containing a matting agent (such as silica), an imaging layer, a protective topcoat layer, or a combination of such layers.

In some embodiments, the photothermographic materials of this invention include a surface protective layer on the same side of the support as the one or more thermally developable layers, an antihalation layer on the opposite side of the support, or both a surface protective layer and an antihalation layer on their respective sides of the support.

It is also contemplated that the photothermographic materials of this invention can include thermally developable imaging (or emulsion) layers on both sides of the support and at least one infrared radiation absorbing heat-bleachable composition in an antihalation underlayer beneath other layers (particularly the imaging layers) on one or both sides of the support.

To promote image sharpness, photothermographic materials according to the present invention can contain one or more layers containing acutance, filter, cross-over prevention (anti-crossover), anti-irradiation, and/or antihalation dyes. These dyes are chosen to have absorption close to the exposure wavelength and are designed to absorb scattered light. One or more antihalation dyes may be incorporated into one or more antihalation layers according to known techniques, as an antihalation backing layer, as an antihalation underlayer, or as an antihalation overcoat. Additionally, one or more acutance dyes may be incorporated into one or more frontside layers such as the photothermographic emulsion layer, primer layer, underlayer, or topcoat layer (particularly on the frontside) according to known techniques. It is preferred that the photothermographic materials of this invention contain an antihalation coating on the support opposite to the side on which the emulsion and topcoat layers are coated.

Dyes useful as antihalation, filter, cross-over prevention (anti-crossover), anti-irradiation, and/or acutance dyes include squaraine dyes described in U.S. Pat. No. 5,380,635 (Gomez et al.), U.S. Pat. No. 6,063,560 (Suzuki et al.), U.S. Pat. No. 6,348,592 (Ramsden et al.), and EP 1 083 459A1 (Kimura), the indolenine dyes described in EP 0 342 810A1 (Leichter), and the cyanine dyes described in U.S. Pat. No. 6,689,547 (Hunt et al.). All of the above references are incorporated herein by reference.

Photothermographic materials having thermally developable layers disposed on both sides of the support often suffer from "crossover." Crossover results when radiation used to image one side of the photothermographic material is transmitted through the support and images the photothermographic layers on the opposite side of the support. Such radiation causes a lowering of image quality (especially sharpness). As crossover is reduced, the sharper becomes the image. Various methods are available for reducing crossover. Such "anti-crossover" materials can be materials specifically included for reducing crossover or they can be acutance or antihalation dyes. In either situation it is necessary that they be rendered colorless during processing. The anti-crossover layer is generally between the imaging layers and the support on either or both sides of the support. Alternatively, the anti-crossover materials are incorporated into the support.

Thus, it is also useful in the present invention to employ compositions including acutance, filter, anti-crossover, anti-irradiation, and/or antihalation dyes that will decolorize or bleach with heat during processing. Dyes and constructions employing these types of dyes are described in, for example, U.S. Pat. No. 5,135,842 (Kitchin et al.), U.S. Pat. No. 5,266,452 (Kitchin et al.), U.S. Pat. No. 5,314,795 (Helland et al.), U.S. Pat. No. 6,306,566, (Sakurada et al.), U.S. Published Application 2001-0001704 (Sakurada et al.), JP Kokai 2001-142175 (Hanyu et al.), and JP Kokai 2001-183770 (Hanye et al.). Also useful are bleaching compositions described in JP Kokai 11-302550 (Fujiwara), JP Kokai 2001-109101 (Adachi), JP Kokai 2001-51371 (Yabuki et al.), and JP Kokai 2000-029168 (Noro). All of the above references are incorporated herein by reference.

Particularly useful heat-bleachable, acutance, filter, anti-crossover, anti-irradiation, and/or antihalation compositions can include a radiation absorbing compound used in combination with a hexaarylbiimidazole (also known as a "HABI"), or mixtures thereof. Such HABI compounds are well known in the art, such as U.S. Pat. No. 4,196,002 (Levinson et al.), U.S. Pat. No. 5,652,091 (Perry et al.), and U.S. Pat. No. 5,672,562 (Perry et al.), all incorporated herein by reference. Additional examples of such heat-bleachable antihalation compositions include hexaarylbiimidazoles (HABI's) used in combination with certain oxonol dyes as described for example in U.S. Pat. No. 6,558,880 (Goswami et al.), or other dyes described for example in U.S. Pat. No. 6,514,677 (Ramsden et al.), both incorporated herein by reference.

Under practical conditions of use, the compositions are heated to provide bleaching at a temperature of at least 90° C. for at least 0.5 seconds. Preferably, bleaching is carried out at a temperature of from about 100° C. to about 200° C. for from about 5 to about 20 seconds. Most preferred bleaching is carried out within 20 seconds at a temperature of from about 110° C. to about 130° C.

Imaging/Development

The photothermographic materials of the present invention can be imaged in any suitable manner consistent with the type of material using any suitable imaging source (typically some type of radiation or electronic signal). The materials can be made sensitive to X-radiation or radiation in the ultraviolet region of the spectrum, the visible region of the spectrum, or the infrared region of the electromagnetic spectrum. For example, in some embodiments, the materials can be sensitive to radiation having a wavelength of from about 350 to about 450 nm, and in other embodiments, the materials can be sensitive to radiation having a wavelength of from about 350 to about 850 nm.

Imaging can be achieved by exposing the photothermographic materials of this invention to a suitable source of radiation to which they are sensitive, including X-radiation, ultraviolet light, visible light, near infrared radiation, and infrared radiation, to provide a latent image.

Suitable X-radiation imaging sources include general medical, mammographic, portal imaging, dental, industrial X-ray units, and other X-radiation generating equipment known to one skilled in the art. Also suitable are light-emitting screen-cassette systems of X-ray radiation units.

Other suitable exposure means are well known and include sources of radiation, including: incandescent or fluorescent lamps, xenon flash lamps, lasers, laser diodes, light emitting diodes, infrared lasers, infrared laser diodes, infrared light-emitting diodes, infrared lamps, or any other ultraviolet, visible, or infrared radiation source readily apparent to one skilled in the art, and others described in the art, such as in *Research Disclosure*, September, 1996, Item 38957. Particularly useful infrared exposure means include laser diodes, including laser diodes that are modulated to increase imaging efficiency using what is known as multi-longitudinal exposure techniques as described in U.S. Pat. No. 5,780,207 (Mohapatra et al.). Other exposure techniques are described in U.S. Pat. No. 5,493,327 (McCallum et al.).

Thermal development conditions will vary, depending on the construction used but will typically involve heating the imagewise exposed material at a suitably elevated temperature. Thus, the latent image can be developed by heating the exposed material at a moderately elevated temperature of, for example, from about 50° C. to about 250° C. (preferably from about 80° C. to about 200° C. and more preferably from about 100° C. to about 200° C.) for a sufficient period of time, generally from about 1 to about 120 seconds. Heating can be accomplished using any suitable heating means such as a hot plate, a steam iron, a hot roller or a heating bath.

In some methods, the development is carried out in two steps. Thermal development takes place at a higher temperature for a shorter time (for example at about 150° C. for up to 10 seconds), followed by thermal diffusion at a lower temperature (for example at about 80° C.) in the presence of a transfer solvent.

Use as a Photomask

The photothermographic materials of the present invention are sufficiently transmissive in the range of from about 350 to about 450 nm in non-imaged areas to allow their use in a method where there is a subsequent exposure of an ultraviolet or short wavelength visible radiation sensitive imageable medium. For example, imaging the photothermographic material and subsequent development affords a visible image. The heat-developed photothermographic material absorbs ultraviolet or short wavelength visible radiation in the areas where there is a visible image and transmits ultraviolet or short wavelength visible radiation where there is no visible image. The heat-developed material may then be used as a mask and positioned between a source of imaging radiation (such as an ultraviolet or short wavelength visible radiation energy source) and an imageable material that is sensitive to such imaging radiation, such as a photopolymer, diazo material, photoresist, or photosensitive printing plate. Exposing the imageable material to the imaging radiation through the visible image in the exposed and heat-developed photothermographic material provides an image in the imageable material. This method is particularly useful where the imageable medium comprises a printing plate and the photothermographic material serves as an imagesetting film.

The present invention also provides a method for the formation of a visible image (usually a black-and-white image) by first exposing to electro-magnetic radiation and thereafter heating the inventive photothermographic material. In one embodiment, the present invention provides a method comprising:

A) imagewise exposing the photothermographic material of this invention to electromagnetic radiation to which the photosensitive silver halide of the material is sensitive, to form a latent image, and B) simultaneously or sequentially, heating the exposed photothermographic material to develop the latent image into a visible image.

For example, the photothermographic material may be exposed in step A using any source of radiation to which they are sensitive, including ultraviolet light, visible light, near infrared radiation, infrared radiation, or any other radiation source readily apparent to one skilled in the art. One particularly preferred form of useful radiation is infrared radiation, including an infrared laser, an infrared laser diode, an infrared light-emitting diode, an infrared lamp, or any other infrared radiation source readily apparent to one skilled in the art.

This visible image can also be used as a mask for exposure of other photosensitive imageable materials, such as graphic arts films, proofing films, printing plates and circuit board films, that are sensitive to suitable imaging radiation (for example, UV radiation). This can be done by imaging an imageable material (such as a photopolymer, a diazo material, a photoresist, or a photosensitive printing plate) through the exposed and heat-developed photothermographic material. Thus, in some other embodiments wherein the photothermographic material comprises a transparent support, the image-forming method further comprises:

C) positioning the exposed and heat-developed photothermographic material with a visible image thereon, between a source of imaging radiation and an imageable material that is sensitive to the imaging radiation, and D) thereafter exposing the imageable material to the imaging radiation through the visible image in the exposed and heat-developed photothermographic material to provide a visible image in the imageable material.

Imaging Assemblies

To further increase photospeed, the X-radiation sensitive photothermographic materials of this invention may be used in combination with one or more phosphor intensifying screens and/or metal screens in what is known as "imaging assemblies." An intensifying screen absorbs X-radiation and emits longer wavelength electromagnetic radiation that the photosensitive silver halide more readily absorbs. Double-sided X-radiation sensitive photothermographic materials (that is, materials having one or more thermally developable imaging layers on both sides of the support) are preferably used in combination with two intensifying screens, one screen in the "front" and one screen in the "back" of the material.

Such imaging assemblies are composed of a photothermographic material as defined herein (particularly one sensitive to X-radiation or visible light) and one or more phosphor intensifying screens adjacent the front and/or back of the material. These screens are typically designed to absorb X-rays and to emit electromagnetic radiation having a wavelength greater than 300 nm.

There are a wide variety of phosphors known in the art that can be formulated into phosphor intensifying screens, including but not limited to, the phosphors described in *Research Disclosure*, August 1979, Item 18431, Section IX, X-ray Screens/Phosphors, U.S. Pat. No. 2,303,942 (Wynd et al.), U.S. Pat. No. 3,778,615 (Luckey), U.S. Pat. No. 4,032,471 (Luckey), U.S. Pat. No. 4,225,653 (Brixner et al.), U.S. Pat. No. 3,418,246 (Royce), U.S. Pat. No. 3,428,247 (Yocon), U.S. Pat. No. 3,725,704 (Buchanan et al.), U.S. Pat. No. 2,725,704 (Swindells), U.S. Pat. No. 3,617,743 (Rabatin), U.S. Pat. No. 3,974,389 (Ferri et al.), U.S. Pat. No. 3,591,516 (Rabatin), U.S. Pat. No. 3,607,770 (Rabatin), U.S. Pat. No. 3,666,676 (Rabatin), U.S. Pat. No. 3,795,814 (Rabatin), U.S. Pat. No. 4,405,691 (Yale), U.S. Pat. No. 4,311,487 (Luckey et al.), U.S. Pat. No. 4,387,141 (Patten), U.S. Pat. No. 5,021,327 (Bunch et al.), U.S. Pat. No. 4,865,944 (Roberts et al.), U.S. Pat. No. 4,994,355 (Dickerson et al.), U.S. Pat. No. 4,997,750 (Dickerson et al.), U.S. Pat. No. 5,064,729 (Zegarski), U.S. Pat. No. 5,108,881 (Dickerson et al.), U.S. Pat. No. 5,250,366 (Nakajima et al.), U.S. Pat. No. 5,871,892 (Dickerson et al.), EP 0 491 116A1 (Benzo et al.), U.S. Pat. No. 4,988,880 (Bryan et al.), U.S. Pat. No. 4,988,881 (Bryan et al.), U.S. Pat. No. 4,994,205 (Bryan et al.), U.S. Pat. No. 5,095,218 (Bryan et al.), U.S. Pat. No. 5,112,700 (Lambert et al.), U.S. Pat. No. 5,124,072 (Dole et al.), U.S. Pat. No. 5,336,893 (Smith et al.), U.S. Pat. No. 4,835,397 (Arakawa et al.), U.S. Pat. No. 5,381,015 (Dooms), U.S. Pat. No. 5,464,568 (Bringley et al.), U.S. Pat. No. 4,226,653 (Brixner), U.S. Pat. No. 5,064,729 (Zegarski), U.S. Pat. No. 5,250,366 (Nakajima et al.), and U.S. Pat. No. 5,626,957 (Benso et al.), U.S. Pat. No. 4,368,390 (Takahashi et al.), and U.S. Pat. No. 5,227,253 (Takasu et al.), the disclosures of which are all incorporated herein by reference for their teaching of phosphors and formulation of phosphor intensifying screens.

Phosphor intensifying screens can take any convenient form providing they meet all of the usual requirements for use in radiographic imaging, as described for example in U.S. Pat. No. 5,021,327 (Bunch et al.), incorporated herein by reference. A variety of such screens are commercially available from several sources including by not limited to, LANEX®, X-SIGHT® and InSight® Skeletal screens available from Eastman Kodak Company. The front and back screens can be appropriately chosen depending upon the type of emissions desired, the photicity desired, emulsion speeds, and % crossover. A metal (such as copper or lead) screen can also be included if desired.

Imaging assemblies can be prepared by arranging a suitable photothermographic material in association with one or more phosphor intensifying screens, and one or more metal screens in a suitable holder (often known as a cassette), and appropriately packaging them for transport and imaging uses.

Constructions and assemblies useful in industrial radiography include, for example, U.S. Pat. No. 4,480,024 (Lyons et al), U.S. Pat. No. 5,900,357 (Feumi-Jantou et al.), and EP 1 350 883A1 (Pesce et al.).

The following examples are provided to illustrate the practice of the present invention and the invention is not meant to be limited thereby.

Materials and Methods for the Examples:

All materials used in the following examples are readily available from standard commercial sources, such as Aldrich Chemical Co. (Milwaukee Wis.) unless otherwise specified. All percentages are by weight unless otherwise indicated.

Determination of Grain Size

A sample of the emulsion was examined by scanning and transmission electron microscopy, and the projected areas of resulting grain images were measured to determine the mean area. The weighting was such that the diameters reported are the equivalent circular diameters of the mean areas for those grains that have an aspect ratio greater than five. Thickness was characterized from the spectral reflectivity of the grains using equations described in *Optics*, John Wiley & Sons, 1970, pp. 582–585, and the refractive dispersion of gelatin and silver bromide given in T. H. James, *The Theory of the Photographic Process*, Fourth Edition, Eastman Kodak Company, Rochester, N.Y., 1977, p.579.

Preparation of Cubic Silver Bromoiodide Control Emulsions A and D

Control A Emulsion: A reaction vessel equipped with a stirrer was charged with 75 g of phthalated gelatin, 1650 g of deionized water, 40 ml of 0.2M KBr solution, an antifoamant and sufficient nitric acid to adjust pH to 5.0, at 50° C. A small amount of AgBrI emulsion grains (0.12 μm, 0.035 mol, 6% I, cubic) were added as seed crystals. Solution A and solution B were added simultaneously while pAg and temperature of the reactor was held constant.

Solution A was prepared at 25° C. as follows:

| | |
|---|---|
| $AgNO_3$ | 743 g |
| deionized water | 1794 g |

Solution B was prepared at 50° C. as follows, then allowed to cool to 25° C. before use.

| | |
|---|---|
| KBr | 559 g |
| KI | 50 g |
| Phenylmercaptotetrazole | 0.25 g |
| deionized Water | 1900 g |

The addition rates of solution A and solution B started at 14 ml/min, then accelerated as a function of total reaction time according to the equation:

Flow Rate=$14(1+0.028t^2)$ ml/min, where $t$ is the time in minutes.

The reaction was terminated when all solution A was consumed. The emulsion was coagulation washed and adjusted pH to 5.5 to give 4.3 mol of control emulsion A. The average grain size was 0.25 μm as determined by Scanning Electron Microscopy (SEM).

Control D Emulsion: This emulsion was prepared in a similarly manner as described in control A except the make temperature was held at 53° C., and phenylmercaptotetrazole was not used.

Control emulsions A and D were evaluated either as a primitive (that is, unsensitized) emulsion or after chemical sensitization at 60° C. for 30 minutes using a combination of a gold sensitizer (potassium tetrachloroaurate) and a sulfur sensitizer (compound SS-1 as described in U.S. Pat. No. 6,296,998). Levels of up to 0.5 mmol of blue sensitizing dye SSD-B1 per mole of AgX were added at 50° C. after the chemical sensitizers.

SSD-B1

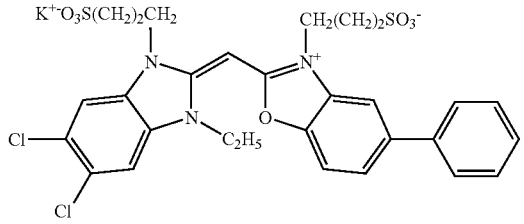

Preparation of Tabular Silver Bromoiodide Control Emulsions B, C, E and F

Control B Emulsion: This emulsion was prepared in a manner similar to that of Emulsion-F described in U.S. Pat. No. 6,159,676 (Lin et al.), incorporated herein by reference.

To a 4.6 liter aqueous solution containing 0.4 weight % of oxidized-methionine bone gelatin and 7 g/l of sodium bromide at 55° C., with vigorous stirring in the reaction vessel, was added (by single-jet addition) 0.42M silver nitrate solution at constant flow rate over a 15 minute period, consuming 1.7% of total silver. Subsequently, 44.9 g of ammonium sulfate was added to the vessel, followed by the addition of 136 ml of 2.5M sodium hydroxide. After 5 minutes, 81.6 ml 4.0M nitric acid was added. This was followed by addition of 2.42 kg of oxidized-methionine bone gelatin dissolved in 2.2 liters of water, and the reaction vessel was held for 3 minutes. This was followed by addition of 0.109 moles sodium bromide. Then, by double jet addition, an aqueous 3.0M silver nitrate solution and an aqueous solution of 3.0M sodium bromide were added simultaneously to the reaction vessel over 46.5 minutes utilizing an accelerated flow rate of 23.2× from start to finish. During this addition, the pBr was kept constant at 1.73 via salt flow feedback and consuming 68.1% of the total silver. At 45 minutes into this segment, 0.003 mg/mol of potassium hexachloro-iridate was added to the reaction vessel. Addition of both silver and salt solutions was halted after the accelerated flow segment while the pBr of the vessel was adjusted to 1.1 by addition of sodium bromide salt. During this time 2.55 mg of potassium selenocyanate dissolved in 218 g water was added. Following a 1 minute hold, a silver iodide Lippmann seed emulsion was added at a quantity representing 3.7% of the total precipitated silver. After a 2 minute hold period, the 3.0M silver nitrate solution was used to adjust the pBr from 1.11 to 2.5. This was followed by addition to the reaction vessel of a 3.0M sodium bromide solution simultaneously with addition of the silver nitrate solution to control pBr at 2.5 until a total of 12.8 moles of silver were prepared. The emulsion was then cooled to 40° C. and washed by ultrafiltration.

This procedure resulted in a 2.01×0.125 μm silver bromoiodide tabular grain emulsion having an overall iodide content of 3.7%. The aspect ratio was 16.08:1.

Control C Emulsion: This emulsion was prepared in a manner analogous manner the Control B Emulsion described above, with the following changes:

the precipitation temperature was 43.5° C.,
51.5 g of ammonium sulfate was used,
94.7 ml of 4.0M nitric acid was used,
156 ml of 2.5M sodium hydroxide was used.

This procedure resulted in a 0.530×0.13 μm silver bromoiodide tabular grain emulsion having an overall iodide content of 3.7%. The aspect ratio was 4.1:1

Control E Emulsion: This emulsion was prepared in an analogous manner to the Control B emulsion described above, with the following changes:

the precipitation temperature was 49.3° C.,
23.8 g of ammonium sulfate was used,
43.6 ml of 4.0M nitric acid was used,
72.2 ml of 2.5M sodium hydroxide was used,
a quantity of silver iodide Lippmann seeds representing 3.0% of total silver was used, Additional changes included:

The initial (single-jet) addition of silver nitrate was carried out over 7.5 minutes (consuming the same 1.7% of total silver using 0.84M silver nitrate aqueous solution) and then the same molar quantity of silver was added over 7.5 minutes by addition of 0.84M silver nitrate solution but this time with simultaneous addition of aqueous 3.0M sodium bromide solution such that pBr was held constant during this second portion. The ammonium sulfate addition and subsequent steps followed as in the Control B emulsion example until the gelatin addition. After the mid-run gelatin addition, instead of sodium bromide, 16.6 ml of a 3.0M silver nitrate solution was added at constant rate over 2.26 minutes. And the pBr was held constant at this resulting value until it is lowered to 1.1 (after the iridium addition as in Control B emulsion).

This procedure resulted in a 1.232×0.121 μm silver bromoiodide tabular grain emulsion having an overall iodide content of 3.0%. The aspect ratio was 10.2:1.

Control F Emulsion: This emulsion was prepared in an analogous manner to the Control E emulsion described above, with the following changes:

the precipitation temperature was 42.3° C., 27.8 g of ammonium sulfate was used, 51.3 ml of 4.0M nitric acid was used, 84.2 ml of 2.5M sodium hydroxide was used.

This procedure resulted in a 0.672×0.139 μm silver bromoiodide tabular grain emulsion having an overall iodide content of 3.7%.

Control emulsions B, C, E and F were evaluated either as primitive emulsions or after chemical sensitization using a combination of a gold sensitizers (potassium tetrachloroaurate or aurous bis(1,4,5-trimethyl-1,2–4-triazolium-3-thiolate) tetrafluoroborate) and a sulfur sensitizer (compound SS-1 as described in U.S. Pat. No. 6,296,998) at 60° C. for 30 minutes. Blue sensitizing dye SSD-B1 (0.5 mmole per mole of AgX) was added at 50° C. before the chemical sensitizers.

Preparation of Ultra-thin Tabular Grain Photosensitive Silver Halide Emulsions Useful In the Invention:

Emulsion A: A vessel equipped with a stirrer was charged with 6 liters of water containing 2.95 g of lime-processed bone gelatin, 5.14 g of sodium bromide, 65.6 mg of KI, a conventional antifoaming agent, and 1.06 g of 0.1M sulfuric acid held at 24° C. During nucleation, which was accomplished by balanced simultaneous 4-second addition of $AgNO_3$ and sodium bromide solutions (both at 2.5M) in sufficient quantity to form 0.03348 moles of silver iodobromide, the pBr and pH values remained approximately at the values initially set in the reaction mixture. Following nucleation, 24.5 g of a 4%-NaOCl aqueous solution was added, then 68.2 g of a 3.42 molar solution of sodium chloride was added. After a temperature increase to 45° C. over 12.5 minutes, there was a 3 minute hold, followed by a cool down to 35° C. over 9 minutes.

After 3 minutes at this temperature, 100 g of oxidized methionine lime-processed bone gelatin dissolved in 1.5 liter of water at 40° C. were added to the vessel. The excess bromide ion concentration was allowed to rise by addition of 62.53 g of a 3.0 molar sodium bromide solution added over 1 minute at a constant rate.

Thirty four minutes after nucleation, the growth stage was begun during which 1.49 molar (later 3.0 molar) $AgNO_3$, 1.49 molar (later 3.0 molar) sodium bromide, and a 0.45 molar suspension of silver iodide (Lippmann emulsion) were added in proportions to maintain a nominal uniform iodide level of (i) 1.5 mole % for the first 75% of the grain growth, (ii) 6 mole % for the 75%–87.25% portion of grain growth, and (iii) pure AgBr for the last portion of grain growth. The flow rates were 6.6 ml/min (initially of the 1.49 molar reactants) and ramped in several accelerated flow segments up to 13.4 ml/min over 15 minutes, to 18.1 ml/min over the next 15 minutes, and then to 26.9 ml/min in the next 15 minutes. After a switch to 3.0 molar reactants, the flow rates were 13.4 ml/min ramped in several segments up to a rate of 64.0 ml/min. During this time the pBr was held in control and 0.01 mg of dipotassium hexachloiridate ($K_2IrCl_6$) per mole of AgX was added. For the 6 mole % iodide addition the flow rate was held at a constant 44.5 mmin and for the final pure bromide growth the pBr was raised to 1.74 and the flow rate held constant at 71.0 ml/min.

A total of 12.3 moles of silver iodobromide (1.87 mole % iodide) were formed. The resulting emulsion was washed by ultra-filtration and pH and pBr were adjusted to storage values of 6 and 2.5, respectively. The emulsion was also examined by Scanning Electron Microscopy to determine grain morphology. Tabular grains accounted for greater than 99% of total grain projected area and the mean ECD of the grains was 0.848 μm. The mean tabular thickness was 0.053 μm. The aspect ratio was 16:1.

Emulsion B: Emulsion B was prepared by a procedure similar to that for Emulsion A except that the grain size was altered by modifying the amount of sodium bromide added during the pBr shift step (just before the main growth steps) and by modifying the amount of silver halide precipitated during the nucleation step in a manner described, for example, in U.S. Pat. No. 5,494,789. The resulting emulsion contains 1.87 mole % iodide and has a grain size of 1.054 μm×0.053 μm. The aspect ratio was 19.9:1.

Emulsion C: Emulsion C was prepared by a procedure similar to that for Emulsions A and B with appropriate grain size adjustments. Moreover, this emulsion is 2.62 mole % iodide by having a nominal halide structure of 1.5 mole % iodide for the first 75% of grain growth and 6 mole % iodide for the last 25% of grain growth. The resulting emulsion has grain size of 0.964 μm×0.049 μM. The aspect ratio was 19.7:1.

Emulsion D: A vessel equipped with a stirrer was charged with 9 liters of water containing 14.1 g of lime-processed bone gelatin, 7.06 g NaBr, 4.96 g ammonium sulfate, an antifoamant, and 9.85 g 4.0M sulfuric acid plus sufficient 0.1M sulfuric acid to adjust pH to 2.5 (at 40° C.). The mixture was held at 35° C. During nucleation, which followed the main acid addition by 8.5 minutes, and which was accomplished by balanced simultaneous 6 second addition of $AgNO_3$ and Na(Br, I) (at 1.5 mole % Iodide) solutions, both at 2.5M, in sufficient quantity to form 0.0339 moles of silver iodobromide. pBr and pH remained approximately at the values initially set in the reactor solution. Following nucleation, the reactor gelatin was quickly oxidized by addition of 471 mg of OXONE (2 $KHSO_5.KHSO_4.K_2SO_4$, purchased from Aldrich) in 90 ml $H_2O$ and the mixture held for ten minutes. Next, 61.0 g of a 2.5M aqueous solution of sodium hydroxide was added (pH to 10).

After 14 minutes at this pH, 100 g of oxidized methionine, deionized, lime-processed bone gelatin dissolved in 1.5 liter of water at 40° C. were added to the reactor and the pH was dropped to 5.8 with 37.6 g of 1.0M sulfuric acid. Next the temperature was raised from 35° C. to 45° C. in 6 minutes. The excess Br concentration is then allowed to rise to a pBr of 1.74 by addition of a 4.0M NaBr solution over about 1.5 minutes at a constant rate of 25 ml/min. This pBr value was maintained throughout the remainder of the precipitation by double jet addition of silver nitrate and salt solutions.

Thirty-eight minutes after nucleation the growth stage was begun during which 2.5M (later 3.8M) $AgNO_3$, 4.0M NaBr, and a 0.25M suspension of AgI (Lippmann) were added in proportions to maintain a uniform iodide level of 3.16 mole % for the first 95% of the grain growth, and (ii) pure AgBr for the last 5% of the growth. The silver flow rate was 7.6 ml/min (initially of the 2.5M $AgNO_3$ reactant) and ramped in several accelerated flow segments up to 15.2 ml/min over 50 minutes. After a switch to 3.8M $AgNO_3$ reactant, the silver flow rate was 10.0 ml/min ramped in several segments up to a rate of 40.0 ml/min over 38 minutes. During this time (at a point of 70% of total silver addition) 0.01 mg/Ag mole of dipotassium iridium hexachloride dopant was added. The final 5% of growth involving pure AgBr was carried out with 3.8M $AgNO_3$ added at a constant rate of 30 cc/minute. A total of 9.0 moles of silver iodobromide (3.0% bulk-I) was formed. The resulting emulsion was washed by ultrafiltration and pH and pBr were adjusted to storage values of 6 and 2.5, respectively. The resulting emulsion was examined by Scanning Electron Microscopy. Tabular grains accounted for greater than 99% of total grain projected area, the mean ECD of the grains was 1.117 μm. The mean tabular thickness was 0.056 μm. The aspect ratio was 19.9:1.

Ultra-thin tabular emulsions A, B, C and D were evaluated either as primitive emulsions or after chemical sensitization at 60° C. for 30 minutes using a combination of a gold sensitizer (potassium tetrachloroaurate—$KAuC_4$) and a —$KAuC_4$) and compound SS-1, a sulfur sensitizer described in U.S. Pat. No. 6,296,998 (Eikenberry et al.). Levels of up to 0.5 mmol of blue sensitizing dye SSD-B1 per mole of AgX were added at 50° C. before the chemical sensitizers.

Emulsion E: A vessel equipped with a stirrer was charged with 6 liters of water containing 4.21 g lime-processed bone gelatin, 4.63 g NaBr, 37.65 mg KI, an antifoamant, and 1.25 ml of 0.1M sulfuric acid. It was then held at 39° C. for 5 minutes. Simultaneous additions were then made of 5.96 ml of 2.5378M $AgNO_3$ and 5.96 ml of 2.5M NaBr over 4 seconds. Following nucleation, 0.745 ml of a 4.69% solution of NaOCl was added. The temperature was increased to 54° C. over 9 minutes. After a 5 minute hold, 100 g of oxidized methionine lime-processed bone gelatin in 1.412 liters of water containing additional antifoamant at 54° C. were then added to the reactor. The reactor temperature was held for 7 minutes, after which 106 ml of 5M NaCl containing 2.103 g of NaSCN was added. The reaction was held for 1 minute.

During the next 38 minutes the first growth stage took place wherein solutions of 0.6M $AgNO_3$, 0.6M NaBr, and a 0.29M suspension of AgI (Lippmann) were added to maintain a nominal uniform iodide level of 4.2 mole %. The flow rates during this growth segment were ramped from 9 to 42 ml/min ($AgNO_3$) and from 0.8 to 3.7 ml/min (AgI). The flow rates of the NaBr were allowed to fluctuate as needed to maintain a constant pBr. At the end of this growth segment 78.8 ml of 3.0M NaBr were added and held for 3.6 minutes.

During the next 75 minutes the second growth stage took place wherein solutions of 3.5M $AgNO_3$ and 4.0M NaBr and a 0.29M suspension of AgI (Lippmann) were added to maintain a nominal iodide level of 4.2 mole %. The flow rates during this segment were ramped from 8.6 to 30 ml/min ($AgNO_3$) and from 4.5 to 15.6 ml/min (AgI). The flow rates of the NaBr were allowed to fluctuate as needed to maintain a constant pBr.

During the next 15.8 minutes the third growth stage took place wherein solutions of 3.5M $AgNO_3$ and 4.0M NaBr and a 0.29M suspension of AgI (Lippmann) were added to maintain a nominal iodide level of 4.2 mole %. The flow rates during this segment were 35 ml/min ($AgNO_3$) and 15.6 ml/min (AgI). The temperature was ramped downward to 47.8° C. during this segment. A 1.5 ml solution containing 0.06 mg of potassium tetrachloroiridate ($KIrCl_4$) was then added below the reactor surface and held for 5 seconds.

During the next 32.9 minutes the fourth growth stage took place wherein solutions of 3.5M $AgNO_3$ and 4.0M NaBr and a 0.29M suspension of AgI (Lippmann) were added to maintain a nominal iodide level of 4.2 mole %. The flow rates during this segment were held constant at 35 ml/min ($AgNO_3$) and 15.6 ml/min (AgI). The temperature was ramped downward to 35° C. during this segment.

A total of 12 moles of silver iodobromide (4.2% bulk iodide) was formed. The resulting emulsion was coagulated using 430.7 g phthalated lime-processed bone gelatin and washed with de-ionized water. Lime-processed bone gelatin (269.3 g) was added along with a biocide and pH and pBr were adjusted to 6 and 2.5 respectively.

The resulting emulsion was examined by Scanning Electron Microscopy. Tabular grains accounted for greater than 99% of the total projected area. The mean ECD of the grains was 2.369 μm. The mean tabular thickness was 0.062 μm. The aspect ratio was 38.2:1.

This emulsion was evaluated either as a primitive emulsion or after chemical sensitization at 60° C. for 10 minutes using a combination of a gold sensitizer (potassium tetrachloroaurate—$KAuCl_4$) and a sulfur sensitizer (compound SS-1 as described in U.S. Pat. No. 6,296,998) and 1.0 mmol of blue sensitizing dye SSD-B2 per mole of AgX was added before the chemical sensitizers.

SSD-B2

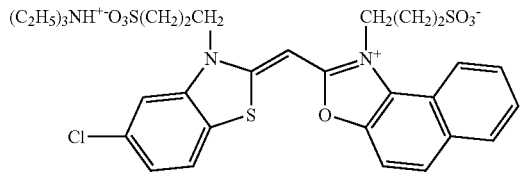

EXAMPLES

Preparation of Aqueous-Based Photothermographic Materials

An aqueous-based photothermographic material of this invention was prepared in the following manner.

Preparation of Silver Salt Dispersion:

A stirred reaction vessel was charged with 85 g of lime-processed gelatin, 25 g of phthalated gelatin, and 2 liters of deionized water (Solution A). Solution B containing 185 g of benzotriazole, 1405 ml of deionized water, and 680 g of 2.5 molar sodium hydroxide was prepared. The reaction vessel solution was adjusted to pAg 7.25 and a pH of 8.0 by addition of Solution B and 2.5M sodium hydroxide solution as needed, and maintained at a temperature of 36° C.

Solution C containing 228.5 g of silver nitrate and 1222 ml of deionized water was added to the reaction vessel at the accelerated flow rate of Flow=$16(1+0.002t^2)$ ml/min wherein "t" is time, and the pAg was maintained at 7.25 by a simultaneous addition of Solution B. This process was terminated when Solution C was exhausted, at which point Solution D of 80 g of phthalated gelatin and 700 ml of deionized water at 40° C. was added to the reaction vessel. The resulting solution in the reaction vessel was stirred and its pH was adjusted to 2.5 with 2 molar sulfuric acid to coagulate the silver salt emulsion. The coagulum was washed twice with 5 liters of deionized water and redispersed by adjusting the pH to 6.0 and vAg to 7.0 with 2.5M sodium hydroxide solution and Solution B. The resulting silver salt dispersion contained fine particles of silver benzotriazole salt.

Preparation of Mercaptotriazole Toner Dispersion:

A mixture containing 4 g of triazole (5-hydroxymethyl-4-benzyl-1,2,4-triazole-3-thiol or 4-benzyl-1,2,4-triazole-3-thiol), 16 g of 10% poly(vinyl pyrrolidone) solution, and 18 ml of deionized water were bead milled with a Brinkmann Instrument S100 grinder for three hours. To the resulting suspension were added 15 g of a 30% lime processed gelatin solution and the mixture was heated to 50° C. on a water bath to give a fine dispersion of mercaptotriazole particles in gelatin.

Photothermographic materials of the present invention were prepared using the noted silver benzotriazole salt, inventive emulsions A through E, and control emulsions A through F, and the components shown below in TABLE I. Each formulation was coated as a single layer on a 7 mil (178 μm) transparent, blue-tinted poly(ethylene terephthalate) film support. Samples were dried at 117° F. (47.2° C.) for 7 minutes.

TABLE I

| Component | Laydown (g/m$^2$) |
|---|---|
| Silver (from Ag benzotriazole salt) | 1.90 |
| Silver (from AgBrI emulsion) | 0.50 |
| 3-Methylbenzothiazolium Iodide | 0.07 |
| Sodium benzotriazole | 0.11 |
| Succinimide | 0.27 |
| 1,3-Dimethylurea | 0.24 |
| Mercaptotriazole Toner | 0.08 |
| Ascorbic acid | 1.10 |
| Lime processed gelatin | approx. 3 |

The resulting photothermographic films were cut into strip samples and imagewise exposed for $10^{-2}$ seconds using a conventional EG&G Mark VII flash sensitometer equipped with a continuous density wedge having an optical density of from 0.0 to 4.0, a P-16 filter and a 0.7 neutral density filter. Following exposure, the films were developed by heating on a heated drum for 15 or 25 seconds at 150° C. to generate continuous tone wedges with image densities varying from a minimum density ($D_{min}$) to a maximum density ($D_{min}$).

Densitometry measurements were made on a custom built computer-scanned densitometer meeting ISO Standards 5–2 and 5-3 and are believed to be comparable to measurements from commercially available densitometers. Density of the wedges were then measured with a computer densitometer using a filter appropriate to the sensitivity of the photothermographic material to obtain graphs of density versus log exposure (that is, D log E curves). Net $D_{min}$ is the density of the non-exposed areas after development minus the density of the support and it is the average of the eight lowest density values.

"Speed-1" is 4 minus the log of the exposure in ergs/cm$^2$ required to achieve a density of 0.25 above $D_{min}$. "Relative Speed-1" was also determined at a density value of 0.25 above $D_{min}$. "Speed-2" is 4 minus the log of the exposure in ergs/cm$^2$ required to achieve a density of 1.00 above $D_{min}$. "Relative Speed-2" was also determined at a density value of 1.00 above $D_{min}$. Speed values were normalized using a control assigned a speed of 100. The larger the Relative Speed number, the less energy (in ergs/cm$^2$) is required to achieve the desired density, and the "faster" the film.

Haze (%) was measured in accord with ASTM D 1003 by conventional means using a Haze-gard Plus Hazemeter that is available from BYK-Gardner, Columbia, Md. Haze is generally not more than 60% for the photothermographic materials of the present invention, and preferably, it is no more than 50%.

The data, shown below in TABLES II and III, clearly show that photothermographic materials according to the present invention exhibited superior sensitometric results and lower haze in comparison to materials outside the present invention.

TABLE II

Sensitometric Data for Primitive AgX Emulsions.

| AgX | Grain Size Type (μm) | Example | Process Time(s) | Net $D_{min}$ | $D_{max}$ | Speed-1 erg/cm$^2$ | Speed-1 Relative | Speed-2 erg/cm$^2$ | Speed-2 Relative | Haze (%) |
|---|---|---|---|---|---|---|---|---|---|---|
| Control A | 0.25 cubic | Comparison | 15 | 0.262 | 2.327 | 2.9 | 233 | 6.8 | 100 | 72.3 |
| Control A | 0.25 cubic | Comparison | 25 | 0.277 | 2.669 | 2.0 | 347 | 3.6 | 188 | — |
| Control B | 1.687 × 0.125 tabular | Comparison | 15 | 0.061 | 0.951 | 16.0 | 42 | — | — | 81.7 |
| Control C | 0.530 × 0.130 tabular | Comparison | 15 | 0.191 | 1.695 | 4.2 | 160 | 40.1 | 17 | 76.8 |
| Control C | 0.530 × 0.130 tabular | Comparison | 25 | 0.197 | 2.227 | 2.0 | 337 | 9.1 | 74 | — |
| Emulsion A | 0.848 × 0.053 tabular | Invention | 15 | 0.131 | 1.938 | 3.4 | 197 | 17.8 | 38 | 46.1 |
| Emulsion A | 0.848 × 0.053 tabular | Invention | 25 | 0.132 | 2.219 | 1.7 | 388 | 3.3 | 207 | — |
| Emulsion B | 1.054 × 0.051 tabular | Invention | 15 | 0.147 | 2.149 | 2.1 | 321 | 10.2 | 66 | 53.1 |
| Emulsion B | 1.054 × 0.051 tabular | Invention | 25 | 0.154 | 2.310 | 0.9 | 718 | 3.4 | 201 | — |
| Emulsion C | 0.964 × 0.049 tabular | Invention | 15 | 0.144 | 1.907 | 2.5 | 268 | 17.9 | 38 | 58.5 |
| Emulsion C | 0.964 × 0.049 tabular | Invention | 25 | 0.147 | 2.157 | 1.2 | 560 | 5.4 | 125 | — |
| Emulsion D | 1.094 × 0.056 tabular | Invention | 15 | 0.153 | 2.463 | 0.9 | 785 | 2.6 | 263 | 44.1 |

TABLE II-continued

Sensitometric Data for Primitive AgX Emulsions.

| AgX | Grain Size Type (μm) | Example | Process Time(s) | Net $D_{min}$ | $D_{max}$ | Speed-1 erg/cm$^2$ | Speed-1 Relative | Speed-2 erg/cm$^2$ | Speed-2 Relative | Haze (%) |
|---|---|---|---|---|---|---|---|---|---|---|
| Emulsion D | 1.094 × 0.056 tabular | Invention | 25 | 0.224 | 2.584 | 0.8 | 863 | 2.3 | 296 | — |
| Emulsion E | 2.369 × 0.06 tabular | Invention | 15 | 0.087 | 2.216 | 1.5 | 439 | 4.5 | 152 | 44.3 |
| Emulsion E | 2.369 × 0.06 tabular | Invention | 25 | 0.109 | 2.382 | 1.0 | 700 | 2.5 | 268 | — |

TABLE III

Sensitometric Data for Chemical and Spectral Sensitized AgX Emulsions.

| AgX | Grain Size Type (μm) | Example | Process Time (s) | Net $D_{min}$ | $D_{max}$ | Speed-1 erg/cm$^2$ | Speed-1 Relative | Speed-2 erg/cm$^2$ | Speed-2 Relative | Haze (%) |
|---|---|---|---|---|---|---|---|---|---|---|
| Control D | 0.27 cubic | Comparison | 15 | 0.290 | 2.353 | 0.2 | 2897 | 0.7 | 1011 | 83.3 |
| Control D | 0.27 cubic | Comparison | 25 | 0.542 | 3.330 | 0.1 | 5609 | 0.3 | 2360 | |
| Control B | 1.631 × 0.125 tabular | Comparison | 15 | 0.217 | 1.062 | 0.5 | 1312 | — | — | 85.4 |
| Control B | 1.631 × 0.125 tabular | Comparison | 25 | 0.417 | 1.592 | 18.6 | 3638 | 215.3 | 3 | — |
| Control E | 1.232 × 0.121 tabular | Comparison | 15 | 0.199 | 1.168 | 0.9 | 736 | — | — | 76.1 |
| Control E | 1.232 × 0.121 tabular | Comparison | 25 | 0.273 | 1.480 | 0.3 | 2118 | 94.2 | 7 | — |
| Control F | 0.672 × 0.139 tabular | Comparison | 15 | 0.253 | 1.461 | 0.5 | 1448 | 111.7 | 6 | 73.9 |
| Control F | 0.672 × 0.139 tabular | Comparison | 25 | 0.291 | 2.067 | 0.2 | 3989 | 2.6 | 256 | — |
| Control C | 0.530 × 0.130 tabular | Comparison | 15 | 0.203 | 1.537 | 0.5 | 1244 | 38.5 | 18 | 74.2 |
| Control C | 0.530 × 0.130 tabular | Comparison | 25 | 0.218 | 1.994 | 0.4 | 1845 | 4.0 | 170 | — |
| Emulsion A | 0.848 × 0.053 tabular | Invention | 15 | 0.192 | 2.459 | 0.6 | 1159 | 2.0 | 347 | 54.0 |
| Emulsion A | 0.848 × 0.053 tabular | Invention | 25 | 0.209 | 2.540 | 0.2 | 4445 | 0.6 | 1169 | — |
| Emulsion B | 1.054 × 0.051 tabular | Invention | 15 | 0.151 | 2.571 | 0.2 | 3311 | 1.6 | 419 | 47.5 |
| Emulsion B | 1.054 × 0.051 tabular | Invention | 25 | 0.204 | 2.834 | 0.2 | 4187 | 0.4 | 1655 | — |
| Emulsion C | 0.964 × 0.049 tabular | Invention | 15 | 0.137 | 1.969 | 0.8 | 855 | 4.4 | 155 | 44.7 |
| Emulsion C | 0.964 × 0.049 tabular | Invention | 25 | 0.231 | 2.227 | 0.2 | 3766 | 1.6 | 422 | — |
| Emulsion D | 1.117 × 0.056 tabular | Invention | 15 | 0.128 | 2.061 | 0.3 | 2037 | 2.0 | 336 | 43.8 |
| Emulsion D | 1.117 × 0.056 tabular | Invention | 25 | 0.209 | 2.150 | 0.1 | 4623 | 0.8 | 820 | — |
| Emulsion E | 2.369 × 0.062 tabular | Invention | 15 | 0.133 | 2.227 | 0.1 | 4752 | 0.6 | 1122 | 38.8 |
| Emulsion E | 2.369 × 0.062 tabular | Invention | 25 | 0.212 | 2.280 | 0.1 | 9097 | 0.3 | 1936 | — |

The invention has been described in detail with particular reference to certain preferred embodiments thereof, but it will be understood that variations and modifications can be effected within the spirit and scope of the invention.

We claim:

1. An aqueous-based black-and-white photothermographic material comprising a support having on at least one side thereof, one or more imaging layers comprising the same or different hydrophilic binders or water-dispersible latex polymer binders, and in reactive association:

a. a non-photosensitive source of reducible silver ions, b. a reducing agent composition for said reducible silver ions, and c. chemically and spectrally sensitized photosensitive silver halide grains, said photothermographic material having a net $D_{min}$ less than 0.25, and requiring less than 1 erg/cm$^2$ to achieve a density of 1.00 above net $D_{min}$.

2. The material of claim 1 wherein said non-photosensitive source of reducible silver ions is a silver salt of a compound containing an imino group.

3. The material of claim 2 wherein said non-photosensitive source of reducible silver ions is a silver salt of benzotriazole or substituted derivatives thereof, or mixtures of such silver salts, said reducing agent composition comprises an ascorbic acid, and said photothermographic material further comprises a mercaptotriazole as a toner.

4. The material of claim 1 wherein said non-photosensitive source of reducible silver ions includes a silver salt of benzotriazole or silver behenate.

5. The material of claim 1 wherein said hydrophilic binder is gelatin, a gelatin derivative, or a poly(vinyl alcohol).

6. The material of claim 1 wherein said binder is a water-dispersible latex polymer.

7. The material of claim 1 wherein at least 85% of the silver halide grain projected area of said photosensitive silver halide grains is projected by tabular silver halide grains that are chemically sensitized with a sulfur, tellurium, selenium, or gold chemical sensitizer, or a combination of a sulfur, tellurium, or selenium chemical sensitizer with a gold chemical sensitizer, or that have been chemically sensitized with an organic sulfur-containing spectral sensitizing dye that has been decomposed in an oxidative environment in the presence of said photosensitive silver halide grains.

8. The material of claim 1 wherein said photosensitive silver halide grains are spectrally sensitized with a spectral sensitizing dye that provides an absorption at a wavelength of from about 350 to about 850 nm.

9. The material of claim 1 having a net $D_{min}$ less than 0.21, and requiring less than 0.6 erg/cm$^2$ to achieve a density of 1.00 above net $D_{min}$.

10. The material of claim 1 wherein said reducing agent composition for said reducible silver ions includes an ascorbic acid or a derivative thereof.

11. The material of claim 1 further comprising a surface protective layer over said one or more imaging layers, an antihalation layer on the backside of said support, or both.

12. The material of claim 1 comprising one or more of the same or different imaging layers on both sides of said support.

13. The material of claim 12 having the same imaging layers having a spectral sensitivity of from about 300 to about 1180 nm on both sides of said support.

14. The material of claim 1 ftuther comprising an antihalation underlayer or an anti-crossover layer between said one or more imaging layers and said support.

15. The photothernographic material of claim 1 comprising an anti-crossover material in said support.

16. The photothermographic material of claim 1 that exhibits a haze, after imaging of less than 60%.

17. The photothermographic material of claim 1 further comprising a thermal solvent that is a polyethylene glycol having a mean molecular weight in the range of 1,500 to 20,000, urea, methyl sulfonamide, ethylene carbonate, tetrahydro-thiophene-1,1-dioxide, methyl anisate, 1,10-decanediol, salicylanilide, phthalimide, N-hydroxyphthalimide, N-potassium-phthalimide, succinimide, N-hydroxy-1,8-naphthalimide, phthalazine, 1-(2H)-phthalazinone, nicotinamide, 2-acetylphthalazinone, benzanilide, dimethylurea, non-polymeric polyhydroxy compounds, benzenesulfonamide, or a combination of succinimide and dimethylurea.

18. An aqueous-based black-and-white photothermographic material comprising a support having on at least one side thereof, one or more imaging layers comprising the same or different hydrophilic binders or water-dispersible latex polymer binders, and in reactive association:

a. a non-photosensitive source of reducible silver ions, b. a reducing agent composition for said reducible silver ions, and c. chemically and spectrally sensitized photosensitive silver iodide or silver bromoiodide grains, said photothermographic material having a net $D_{min}$ less than 0.25, and requiring less than 1 erg/cm$^2$ to achieve a density of 1.00 above net $D_{min}$.

19. An aqueous-based black-and-white photothermographic material comprising a support having on at least one side thereof, one or more imaging layers comprising the same or different hydrophilic binders or water-dispersible latex polymer binders, and in reactive association:

a. a non-photosensitive source of reducible silver ions, b. a reducing agent composition for said reducible silver ions, and c. chemically sensitized photosensitive silver bromide, silver iodide, or silver bromoiodide tabular grains, said tabular grains having an average thickness of at least 0.02 μm and up to and including 0.10 μm, an equivalent circular diameter of at least 0.5 μm and up to and including 8 μm, and an aspect ratio of at least 5:1.

20. The photothermographic material of claim 19 wherein said non-photosensitive source of reducible silver ions includes a silver salt of benzotriazole or silver behenate.

21. An aqueous-based black-and-white photothermographic material comprising a support having on both sides thereof, one or more of the same or different imaging layers comprising the same or different hydrophilic binders or water-dispersible latex polymer binders, and in reactive association:

a. a non-photosensitive source of reducible silver ions that includes a silver benzotriazole, b. a reducing agent composition for said reducible silver ions that is an ester of ascorbic acid, and c. chemically and spectrally sensitized preformed photosensitive tabular silver bromoiodide grains, said photothermographic material having a net $D_{min}$ less than 0.25, and requiring less than 1 erg/cm$^2$ to achieve a density of 1.00 above net $D_{min}$.

22. A method of forming a visible image comprising:

A) imagewise exposing the photothermographic material as claimed in claim 1 to electromagnetic radiation in the range of from about 300 to about 1180 nm to form a latent image, and B) simultaneously or sequentially, heating said exposed photothermographic material to develop said latent image into a visible image.

23. The method of claim 22 wherein said photothermographic material comprises a transparent support, and said image-forming method further comprises:

C) positioning said exposed and heat-developed photothermographic material with the visible image thereon, between a source of imaging radiation and an imageable material that is sensitive to said imaging radiation, and D) exposing said imageable material to said imaging radiation through the visible image in said exposed and heat-developed photothermographic material to provide an image in said imageable material.

24. The method of claim 22 wherein said photothermographic material is imagewise exposed at radiation in the range of from about 350 to about 850 nm.

25. The method of claim 24 wherein said photothermographic material is imagewise exposed by the emission from a phosphor intensifying screen.

26. The method of claim 22 comprising using said visible image for medical diagnosis.

27. A method of forming a visible image comprising:

A) imagewise exposing the photothermographic material of claim 21 to visible radiation from a phosphor intensifying screen to generate a latent image, and B) simultaneously or sequentially, heating said exposed photothermographic material to develop said latent image into a visible image.

28. An imaging assembly comprising the photothermographic material as claimed in claim 1 that is arranged in association with one or more phosphor intensifying screens.

29. An imaging assembly comprising:

A) an aqueous-based black-and-white photothermographic material comprising a support having on at least one side thereof, one or more imaging layers comprising the same or different hydrophilic binders or water-dispersible latex polymer binders, and in reactive association:

a. a non-photosensitive source of reducible silver ions, b. a reducing agent composition for said reducible silver ions, and c. chemically and spectrally sensitized photosensitive silver iodide or bromoiodide grains, said photothermographic material having a net $D_{min}$ less than 0.25, and requiring less than 1 erg/cm$^2$ to achieve a density of 1.00 above net $D_{min}$, and B) said photothermographic material being arranged in association with one or more phosphor intensifying screens.

* * * * *